US008627538B2

(12) United States Patent
Phelan et al.

(10) Patent No.: US 8,627,538 B2
(45) Date of Patent: Jan. 14, 2014

(54) WET AND/OR DRY VACUUM WITH FLOOR COLLECTOR

(75) Inventors: Katherine E. Phelan, Towson, MD (US); Gregg L. Sheddy, Shrewsbury, PA (US)

(73) Assignee: Black & Decker Inc., Newark, DE (US)

( * ) Notice: Subject to any disclaimer, the term of this patent is extended or adjusted under 35 U.S.C. 154(b) by 1125 days.

(21) Appl. No.: 11/941,471

(22) Filed: Nov. 16, 2007

(65) Prior Publication Data

US 2008/0115307 A1 May 22, 2008

Related U.S. Application Data

(63) Continuation-in-part of application No. 11/870,986, filed on Oct. 11, 2007, now Pat. No. 7,877,839.

(60) Provisional application No. 60/859,946, filed on Nov. 20, 2006.

(51) Int. Cl.
*A47L 5/00* (2006.01)
*A47L 9/02* (2006.01)

(52) U.S. Cl.
USPC ..... 15/246.4; 15/418; 15/419

(58) Field of Classification Search
USPC ..... 15/347, 340.1, 415.1, 418, 246.4, 419, 15/420, 422, 333, 334, 357
See application file for complete search history.

(56) References Cited

U.S. PATENT DOCUMENTS

| | | | | | |
|---|---|---|---|---|---|
| 3,634,904 | A | * | 1/1972 | Larsen | 15/340.3 |
| 3,813,725 | A | * | 6/1974 | Rinker | 15/347 |
| 4,360,947 | A | | 11/1982 | DeCosa et al. | |
| 4,660,248 | A | * | 4/1987 | Young | 15/340.1 |
| 4,833,752 | A | | 5/1989 | Merrick | |
| 5,437,078 | A | | 8/1995 | Courcelles et al. | |
| 5,564,161 | A | | 10/1996 | Glatz et al. | |
| 5,839,157 | A | * | 11/1998 | Strauser et al. | 15/347 |
| 5,953,788 | A | | 9/1999 | Douglas | |
| 5,983,442 | A | | 11/1999 | Louis et al. | |
| 6,671,924 | B1 | | 1/2004 | Rood | |
| 6,839,934 | B2 | | 1/2005 | Houghton et al. | |
| 6,895,632 | B2 | | 5/2005 | Murray | |
| 7,053,578 | B2 | | 5/2006 | Diehl et al. | |
| 7,055,210 | B2 | | 6/2006 | Keppler et al. | |
| 7,096,532 | B2 | | 8/2006 | Rood | |
| 7,171,719 | B1 | | 2/2007 | Harrelson | |
| 7,171,723 | B2 | * | 2/2007 | Kobayashi et al. | 15/325 |

* cited by examiner

*Primary Examiner* — Dung Van Nguyen
(74) *Attorney, Agent, or Firm* — Harness, Dickey & Pierce, P.L.C.

(57) ABSTRACT

A vacuum can include a housing having an inlet adapted to receive debris being vacuumed. A mounting bar can be fixedly coupled to the housing. A floor collector assembly can be rotatably disposed about a first axis defined by the mounting bar. The floor collector assembly can include a floor scoop that, in the use mode, can be pivoted to be disposed adjacent to the floor. The front wall of the floor scoop can define a recess that allows debris to pass under the recess so that the floor collector assembly can be used in a debris pickup mode. A visor can be mounted to the floor scoop and can be moved to a closed position to block at least a portion of the recess so that the floor collection assembly can be used in a water pickup mode.

20 Claims, 24 Drawing Sheets

WET AND/OR DRY VACUUM WITH FLOOR COLLECTOR

CROSS-REFERENCE TO RELATED APPLICATIONS

This application is a continuation-in-part of U.S. patent application Ser. No. 11/870,986, filed Oct. 11, 2007, which claims priority to U.S. patent application Ser. No. 60/859,946, filed on Nov. 20, 2006. The disclosures of the above applications are incorporated herein by reference.

FIELD

The present disclosure relates to vacuums and more particularly to a wet/dry vacuum having multiple operating modes.

BACKGROUND

Wet/dry vacuums may be used to collect solid materials such as dirt, debris etc., as well as liquids, such as water etc. In some examples, a hose may be connected on a first end to an inlet port on a collection tub. A motor may be disposed within or about the vacuum that is operable to drive an impellor. Rotation of the impellor may create a vacuum pressure to siphon or otherwise urge the solid and/or liquid material through the hose and into the collection tub. In some examples, the hose may be connected at an opposite end to a hand held tube or accessory. During use, an operator may manually move the hand held tube or accessory onto or near the solid and/or liquid to be vacuumed.

SUMMARY

A vacuum can include a housing having an inlet adapted to receive debris being vacuumed. A mounting bar can be fixedly coupled to the housing. A floor collector assembly can be rotatably disposed about a first axis defined by the mounting bar. The floor collector assembly can include a floor scoop that, in the use mode, can be pivoted to be disposed adjacent to the floor. The front wall of the floor scoop can define a recess that allows debris to pass under the recess so that the floor collector assembly can be used in a debris pickup mode. A movable panel/visor can be mounted to the floor scoop and can be moved to a closed position to block at least a portion of the recess so that the floor collection assembly can be used in a water pickup mode.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 16 is a front perspective view of an exemplary wet/dry vacuum constructed in accordance to additional features of the present disclosure;

DETAILED DESCRIPTION

Figure 1:
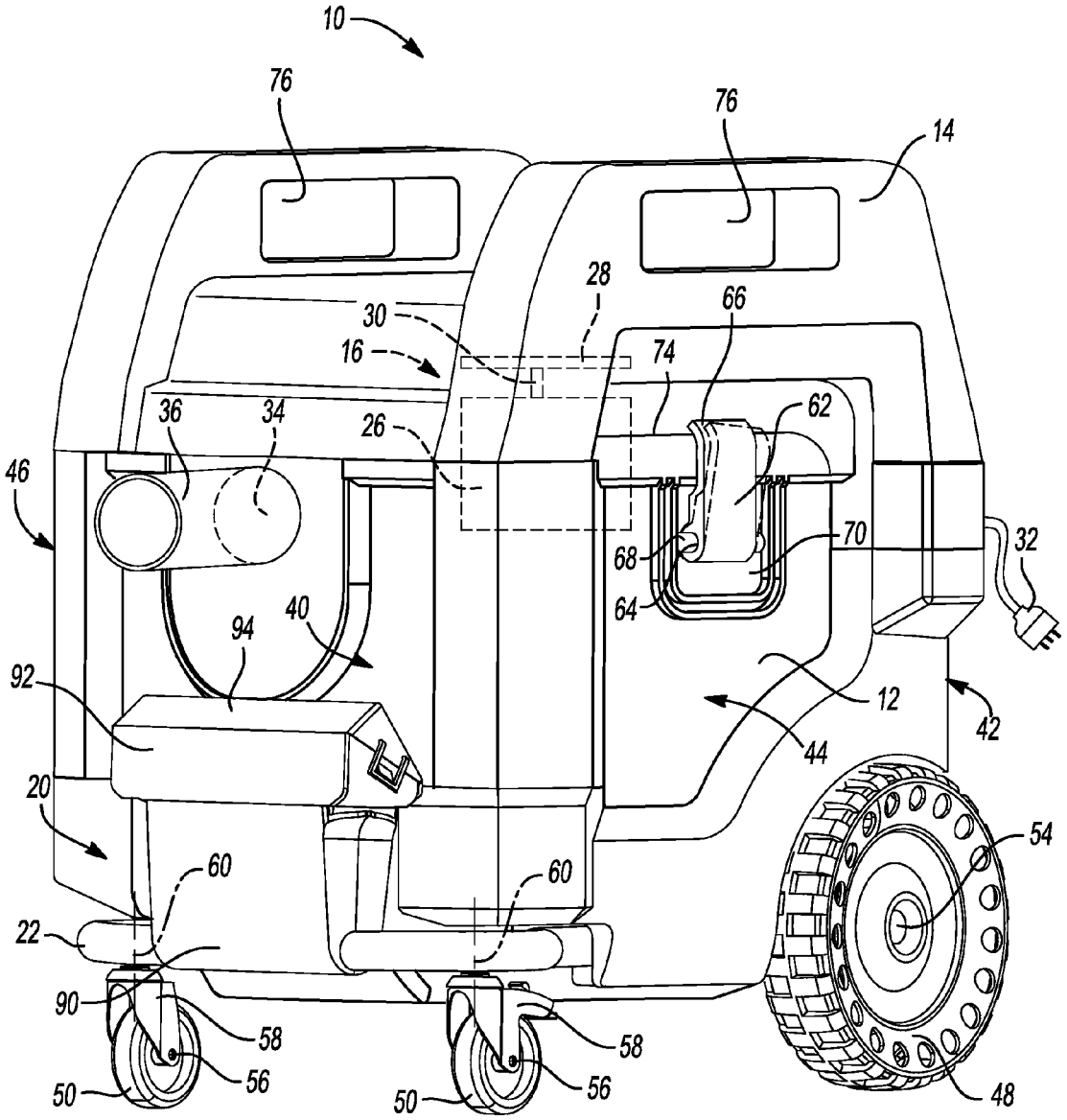
FIG. 1 is a front perspective view of an exemplary wet/dry vacuum constructed in accordance with the teachings of the present disclosure.

With initial reference to FIG. 1, an exemplary vacuum constructed in accordance with the present teachings is shown and generally identified at reference numeral 10. The vacuum 10 can generally include a housing 12, a cover 14, a motor assembly 16, and a floor collector assembly 20. The floor collector assembly 20 can be rotatably coupled to a mounting bar 22 extending from the housing 12. The motor assembly 16 can be disposed within the housing 12 and/or the cover 14. The motor assembly 16 can include a motor 26 that drives an impeller (fan) 28 through an output shaft 30. The motor 26 can be powered by an AC source by way of an electrical plug 32. An on/off switch (not shown) may be provided on the housing 12 or cover 14. An inlet 34 can be defined on the housing 12. An intake port 36 can be integrally formed or otherwise coupled to the housing 12 at the inlet 34. During operation of the vacuum 10, rotation of the impeller 28 can cause suction within the housing 10 for ingesting debris and/or liquid through the inlet 34. Exhausted air may exit the housing 12 at an outlet port (not specifically shown).

The exemplary vacuum 10 can define a cube-like shape having opposing front and rear sides 40 and 42 connected between opposing connecting sides 44 and 46. A first and second pair of wheels, 48 and 50, respectively, may be coupled to the vacuum 10 for rolling the vacuum 10 across a floor. The first pair of wheels 48 (only one shown) may be fixed for rotation about an axle 54 that defines an axis generally parallel to the front and rear sides 40 and 42. The second pair of wheels 50 can be caster wheels that rotate about axles within respective carriers 58. The carriers 58 can be coupled to the mounting bar 22 for rotation about respective axes 60. Other wheel configurations may be employed.

A pair of latches 62 (only one shown) can be disposed on the opposing sides 44 and 46 of the vacuum 10. Description of the exposed latch 62 on the opposing side 44 will now be described while it is appreciated that the same latch configuration may be provided on the other opposing side 46. The latch 62 can generally define a mounting bore 64 on a first end and a curved retaining portion 66 on a second end. The latch 62 can be mounted about a shaft 68 extending in a pocket 70 defined on the opposing side 44. The latch 62 can rotate about the shaft 68 between a secured position (solid line, FIG. 1) wherein the curved retaining portion 66 captures a ledge 74 of the cover 14, and an unsecured position (phantom line, FIG. 1). In the unsecured position, the cover 14 can be lifted (i.e., in a direction upward as viewed in FIG. 1) away from the housing 12 for accessing the motor assembly 16 and/or emptying the vacuumed contents from the housing 12. The cover 14 can define a pair of handles 76 formed thereon. An operator can grasp the handles 76 to move the vacuum 10 as a whole or lift the cover 14 away from the housing 12.

With continued reference to FIG. 1 and additional reference to FIGS. 2 and 3, the mounting bar 22 and floor collection assembly 20 will be described in greater detail. The mounting bar 22 can define a tubular member having a linear central portion 80, a pair of linear end portions 82, and a pair of curved portions 84 that transition between the linear central portion 80 and the linear end portions 82. Apertures 86 can be formed through the mounting bar 22 for receiving fasteners (not shown) to couple to mounting bar 22 to the housing 12.

Figure 2:
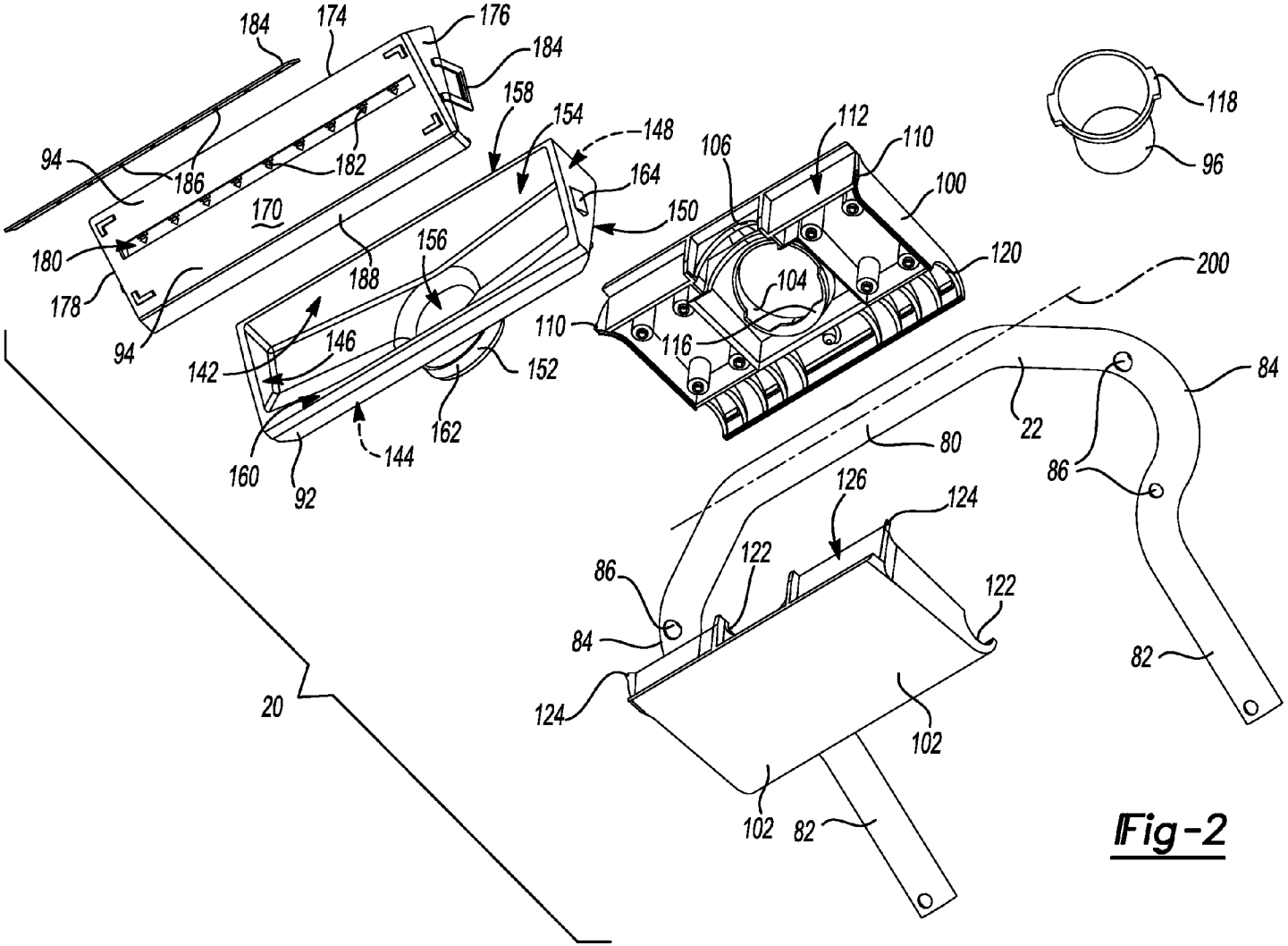
FIG. 2 is an exploded perspective view of a floor collector assembly and mounting bar of the wet/dry vacuum of FIG. 1.

The floor collection assembly 20 can include a connecting duct 90 (FIG. 1), a floor scoop 92, a squeegee adapter 94, and a hose cuff 96 (FIG. 2). The connecting duct 90 can be collectively defined by a first and a second clamshell portion 100 and 102 (FIG. 2), respectively. The first clamshell portion 100 can define a mounting sleeve 104 and a first semi-hemispherical wall portion 106. The mounting sleeve 104 can be adapted to receive the hose cuff 96. First fingers 110 can be formed on a forward face 112 of the first clamshell portion 100. A first annular lip 116 can be formed on the mounting sleeve 104 for cooperatively mating with a second annular lip 118 formed on the hose cuff 96. A first half-cylinder 120 can be defined on the first clamshell portion 100. A second semi-hemispherical wall portion 122 can be defined on the second clamshell portion 102. Second fingers 124 can be formed on a forward face 126 of the second clamshell portion 102.

Figure 3:
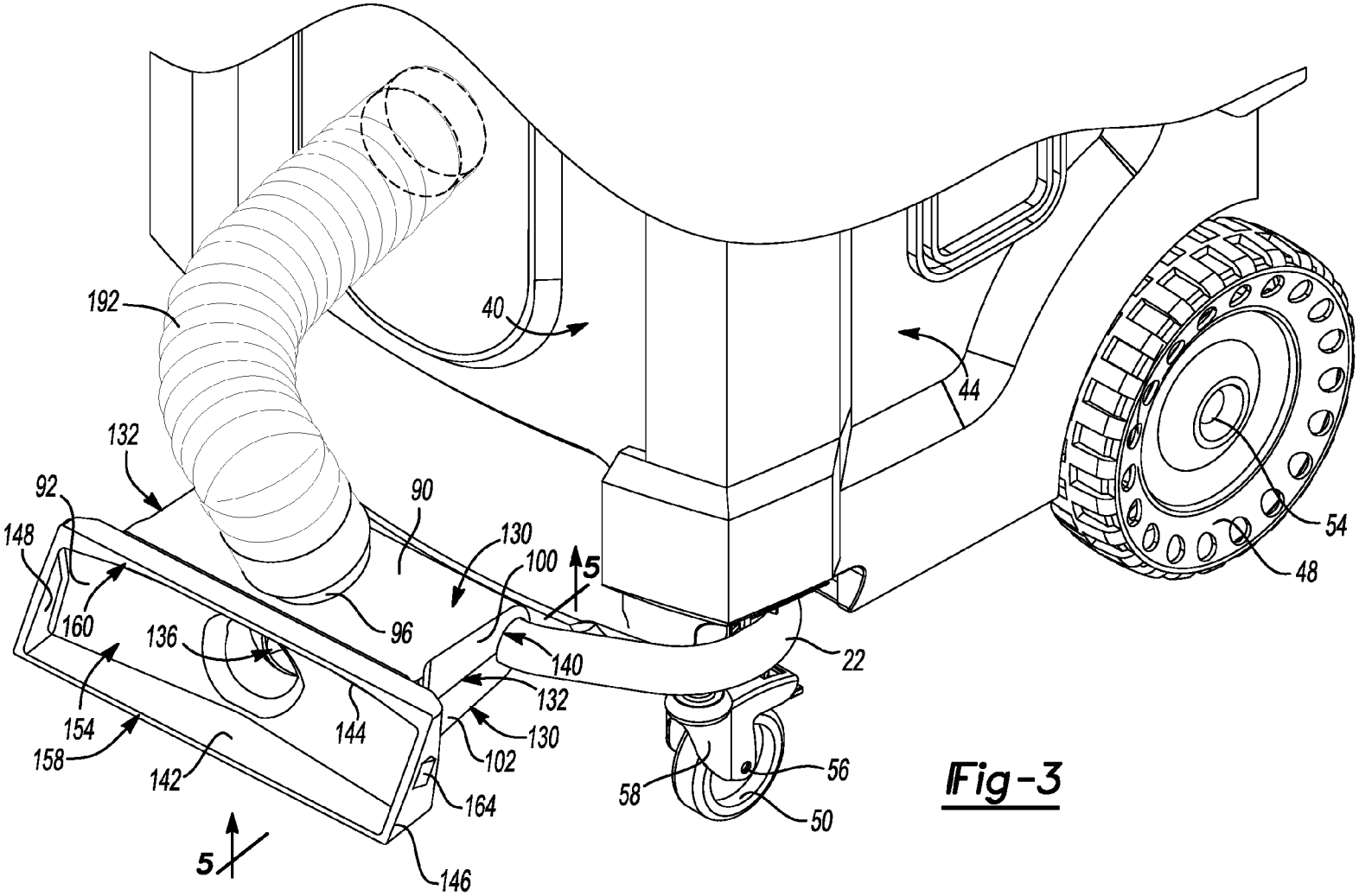
FIG. 3 is a front perspective view of a portion of the vacuum of FIG. 1 including a floor scoop and connecting duct shown in a first (or sweep) mode of operation.

The connecting duct 90 can generally define a first and a second pair of opposing sides 130 and 132, respectively in an assembled position (FIG. 3). A mounting bore 136 can be collectively defined by the first and second semi-hemispherical wall portions 106 and 122. The first and second half-cylinders 120 and 122 can cooperatively define a mounting cylinder 140 (FIG. 3) for accepting the central portion 80 of the mounting bar 22 in the assembled position. The connecting duct 90 can be formed of durable lightweight material such as plastic.

Returning now to FIG. 2, the floor scoop 92 can generally define a first pair of opposing surfaces 142 and 144, a second pair of opposing surfaces 146 and 148, a back surface 150, and a collar 152. An opening 154 is defined collectively by the opposing surfaces 142, 144, 146, and 148. The back surface 150 and the collar 152 can cooperate to define a chute 156. The first surface 142 of the first pair of opposing surfaces 142 and 144 can be larger than the second surface 144 of the first pair of opposing surfaces 142 and 144 such that the opening 154 can define an acute angle β (FIG. 4) relative to the back surface 150. The first surface 142 can define a first sweep edge 158. The second surface 144 can define a second sweep edge 160. The collar 152 can be generally cylindrical and extend from the back surface 150. An annular ring 162 can be integrally formed around the collar 152. A pair of tabs 164 can be formed on the second pair of opposing surfaces 146 and 148, respectively. The back surface 150 can define a pair of hubs 166 (best shown in FIG. 6). The floor scoop 92 can be formed of durable lightweight material such as plastic.

With continued reference to FIG. 2, the squeegee adapter 94 can define a bottom surface 170, a forward surface 172 and a pair of side surfaces 174 and 176. A longitudinal opening 180 can be formed through the bottom surface 170. A plurality of connecting pins 182 can be formed on the squeegee adapter 94 adjacent to the longitudinal opening 180. In one example, the connecting pins can define Christmas tree retainers although other configurations or arrangements are contemplated. A blade 184 can define a complementary plurality of passages 186 for accepting the connecting pins 182 in an installed position (see also FIG. 16). The blade 184 can define a linear body that substantially corresponds for accommodation by the longitudinal opening 180. A pair of ears 184 can be formed on the pair of side surfaces 176 and 178, respectively. A flap 188 can be formed along the bottom surface 170 of the squeegee adapter 94. The squeegee adapter 94 can be formed of a durable lightweight material such as plastic while the blade 184 can be formed of resilient material such as rubber.

With reference now to all FIGS., the vacuum 10 according to the present teachings is operable in a plurality of operating modes. More specifically, the floor collector assembly 20 can be manipulated into multiple shapes and orientations to accommodate a given task. The various modes can include a first or "sweep mode" (FIGS. 3-5), a second or "floor nozzle mode" (FIGS. 9-11), and a third or "squeegee mode" (FIGS. 13-16). The vacuum 10 can also operate in a fourth mode wherein a connecting hose 192 coupled between the intake port 36 and the hose cuff 96 of the floor collector assembly 20 is disconnected from the hose cuff 96 and used as a conventional vacuum hose. In the fourth mode, the floor collection assembly 20 can be rotated about the mounting bar 22 to a transportation position (FIG. 1).

Figure 4:
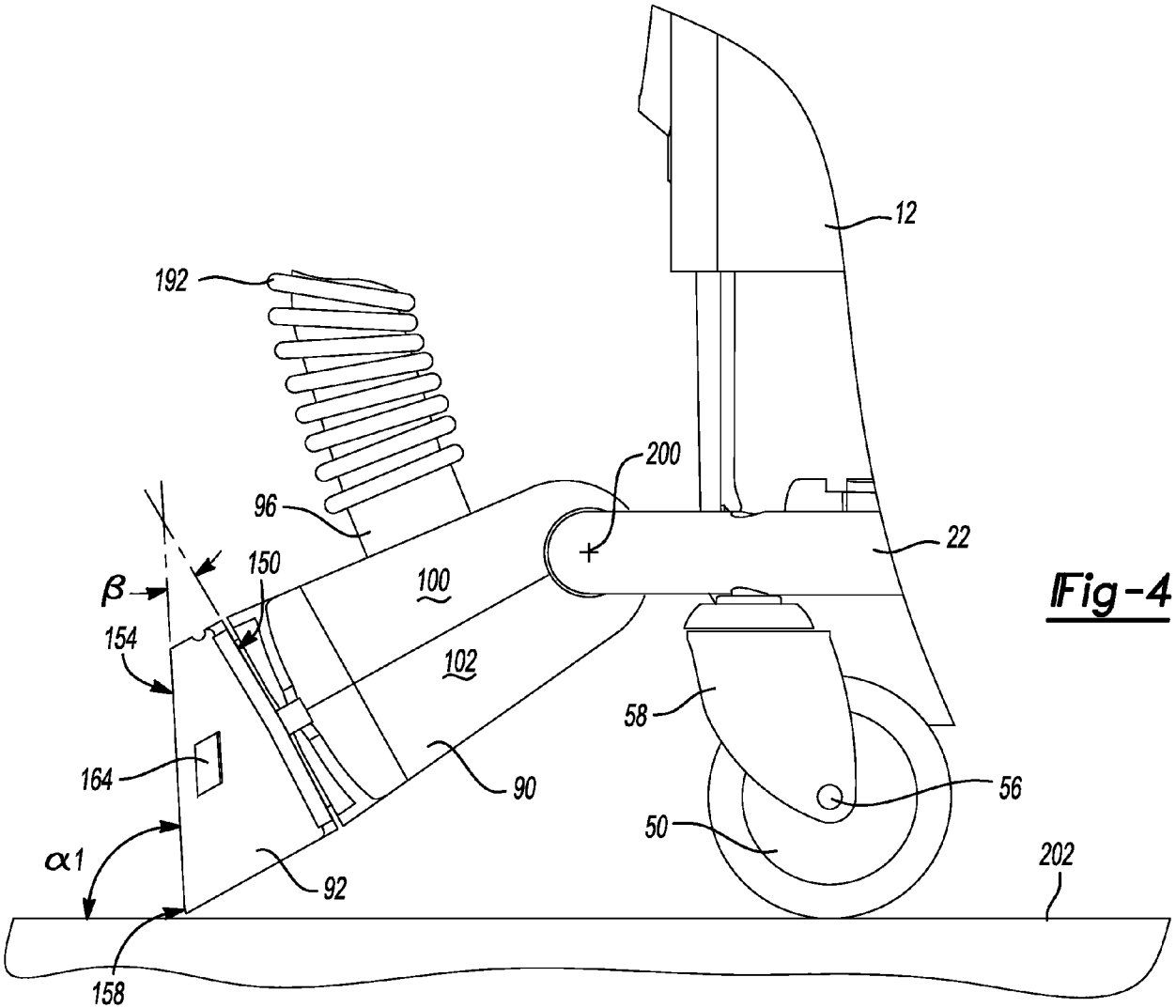
FIG. 4 is a side view of a portion of the vacuum shown in FIG. 3.
Figure 5:
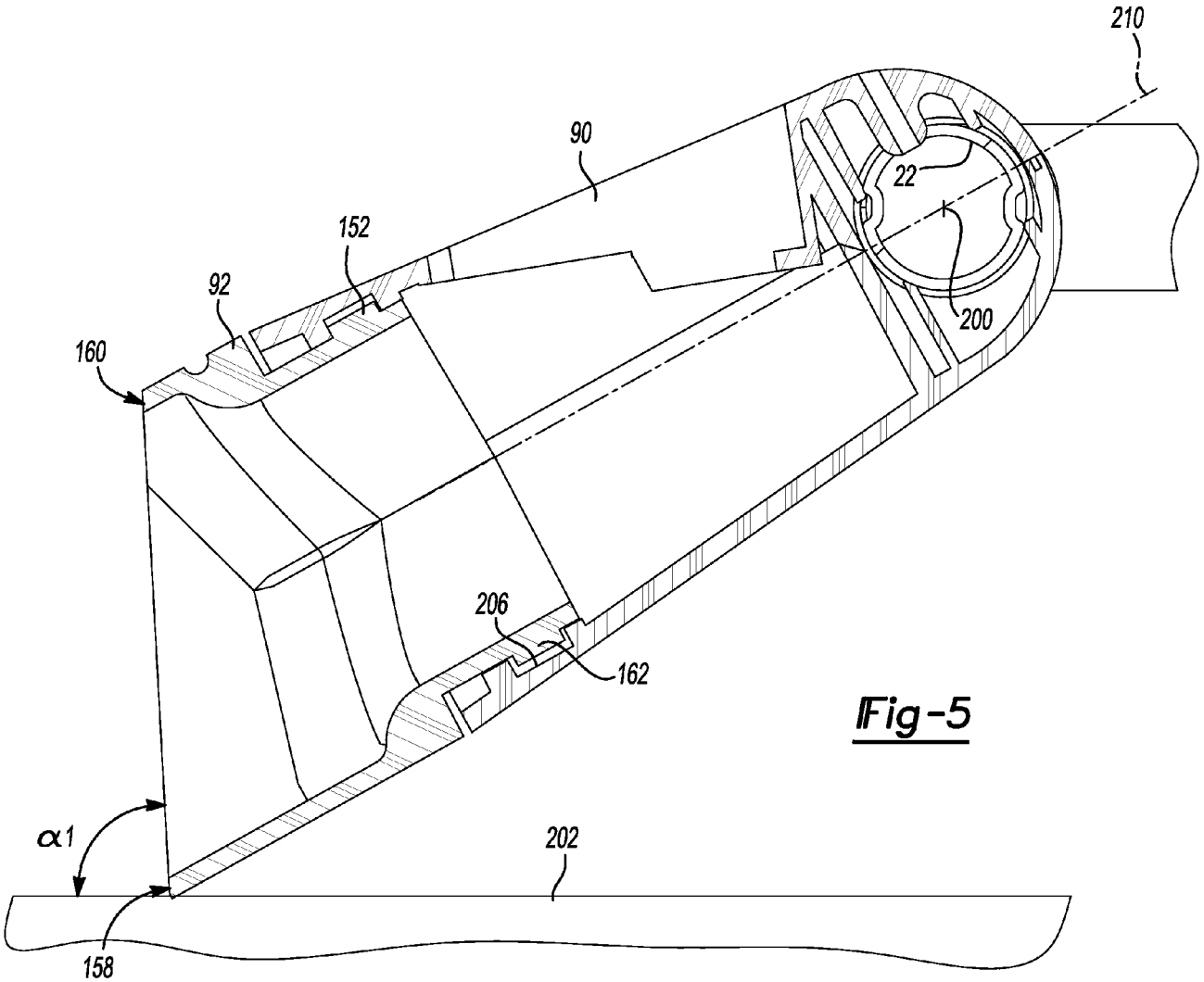
FIG. 5 is a sectional view of the floor scoop and connecting duct in the first mode taken along line 5-5 of FIG. 3.

With particular reference now to FIGS. 3-5, operation of the vacuum 10 in the "sweep mode" will be described in greater detail. In the "sweep mode", the connecting duct 90 is rotated about an axis 200 defined by the mounting bar 22 such that the first sweep edge 158 slides against or substantially adjacent to a vacuumed surface 202. The connecting hose 192 can be coupled between the intake port 36 and the hose cuff 96. In this position, the opening 154 of the floor scoop 92 can define an angle $\alpha 1$ relative to the vacuumed surface 202. The angle $\alpha 1$ can be substantially about 90 degrees. It is appreciated that this angle can be altered by rotating the connecting duct 90 about the mounting bar axis 200. The annular ring 162 (FIG. 5) of the floor scoop 92 can nest within an annular pocket 206 defined inboard of the first and second semi-hemispherical wall portions 106 on the connecting duct 90. In the "sweep mode," the floor scoop 92, the connecting duct 90 and the connecting hose 192 each act as sequential debris-passing ducts to direct the vacuumed material into the housing 12.

Figure 6:
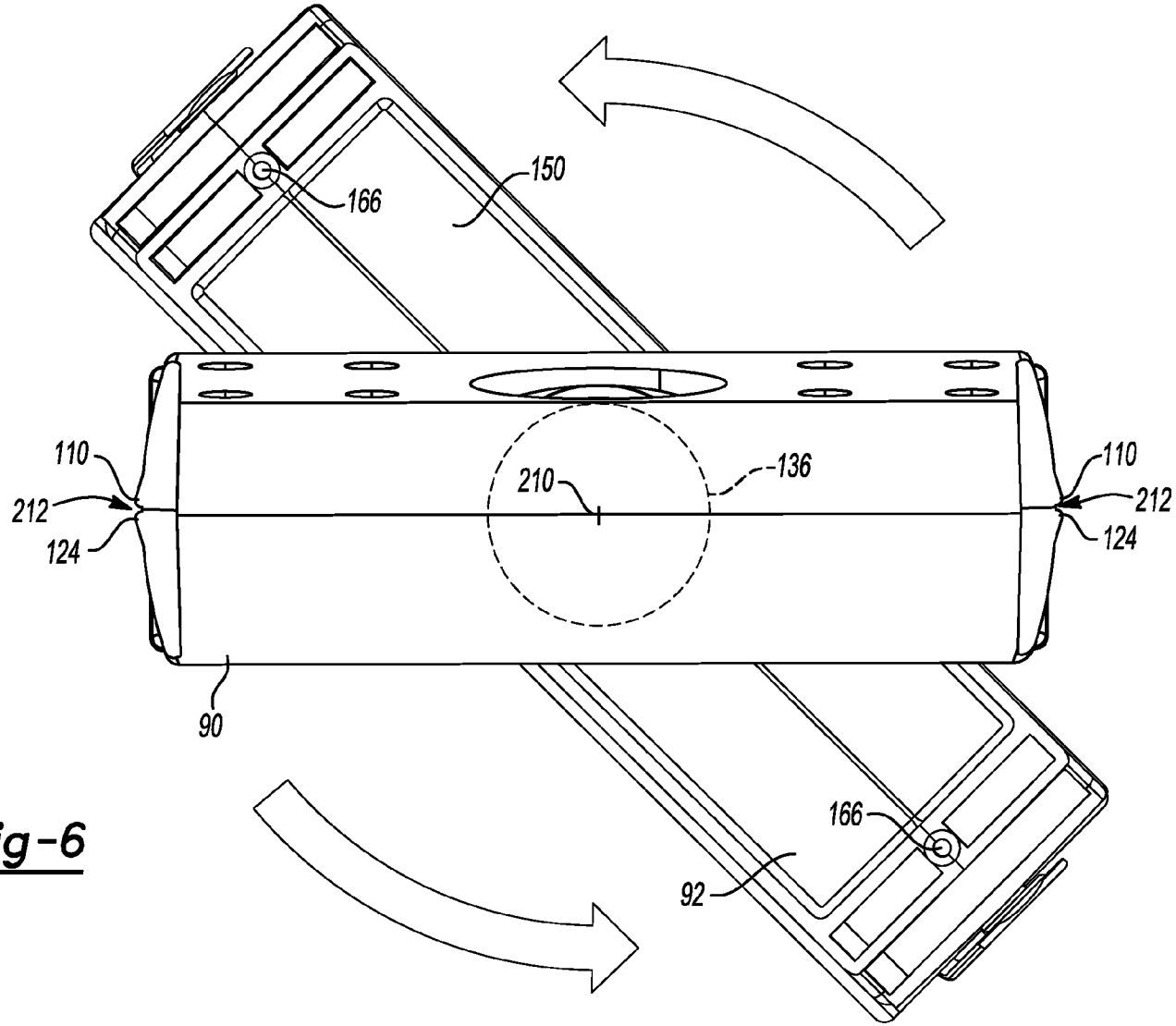
FIG. 6 is an action sequence illustrating rotation of the floor scoop relative to the connecting duct.
Figure 8:
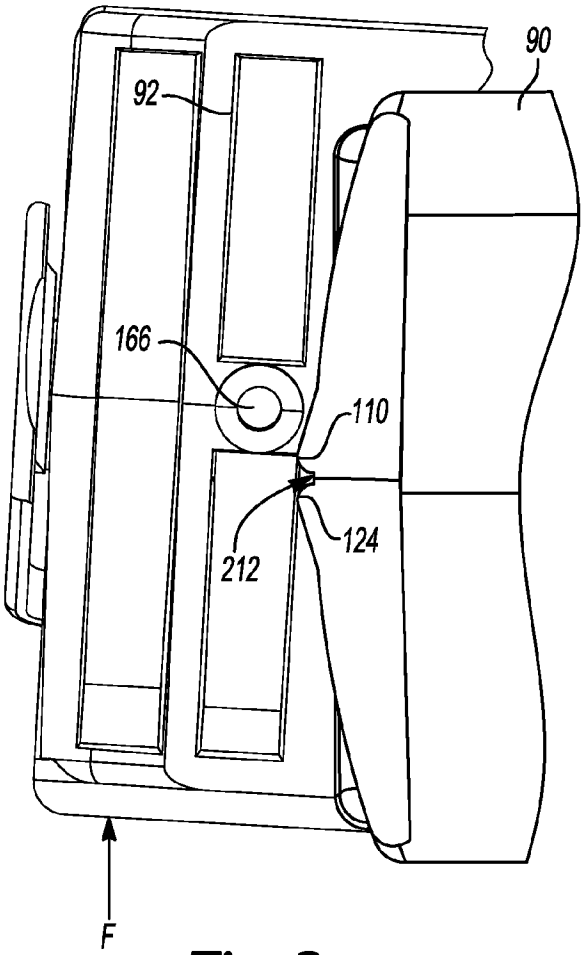
FIG. 8 is a detail view of the hub of the floor scoop in an unengaged position relative to cooperating fingers disposed on the connecting duct.
Figure 7:
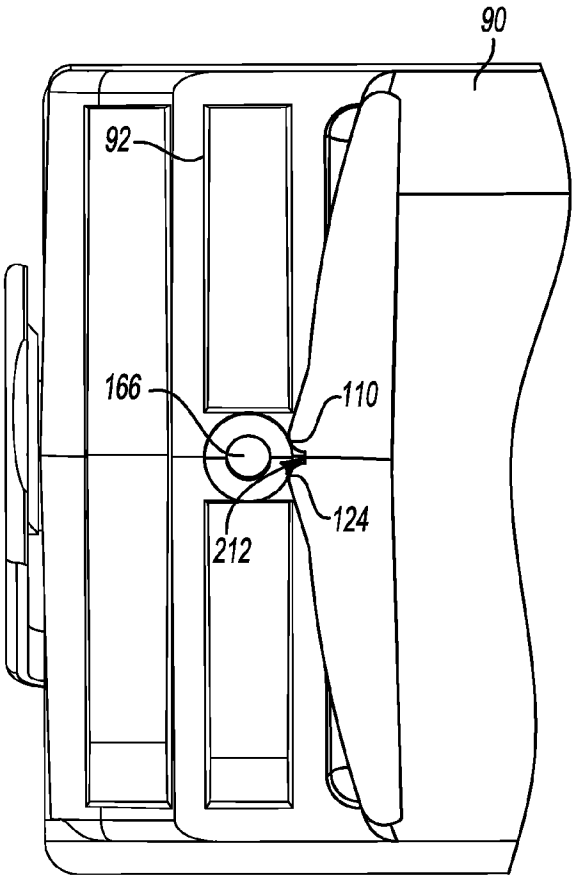
FIG. 7 is a detail view of a hub disposed on the floor scoop in a nested between cooperating fingers of the connecting duct in an engaged position.

With continued reference to FIG. 5 and additional reference to FIGS. 6-8, movement of the floor scoop 92 relative to the connecting duct 90 will be described. In general, the collar 152 (FIGS. 2 and 5) can selectively rotate about an axis 210 (FIG. 5) defined by the mounting bore 136 of the connecting duct 90. During rotation, the annular ring 162 of the floor scoop 92 can ride within the annular pocket 206 of the connecting duct 90 (FIG. 5). As shown in FIG. 7, while in one of the modes (i.e., sweep mode, floor nozzle mode, etc.), the hubs 166 (only one shown) of the floor scoop 92 positively nest in a locked position within a notch 212 defined between the fingers 110 and 124 of the connecting duct 90. Upon enough rotational force F (FIG. 8) administered by a user onto the floor scoop 92, the hub 166 can ramp out of the notch 212 over one of the fingers 110 or 124 into an unlocked position (i.e., for free rotation of the floor scoop 92 about the axis 210).

Figure 9:
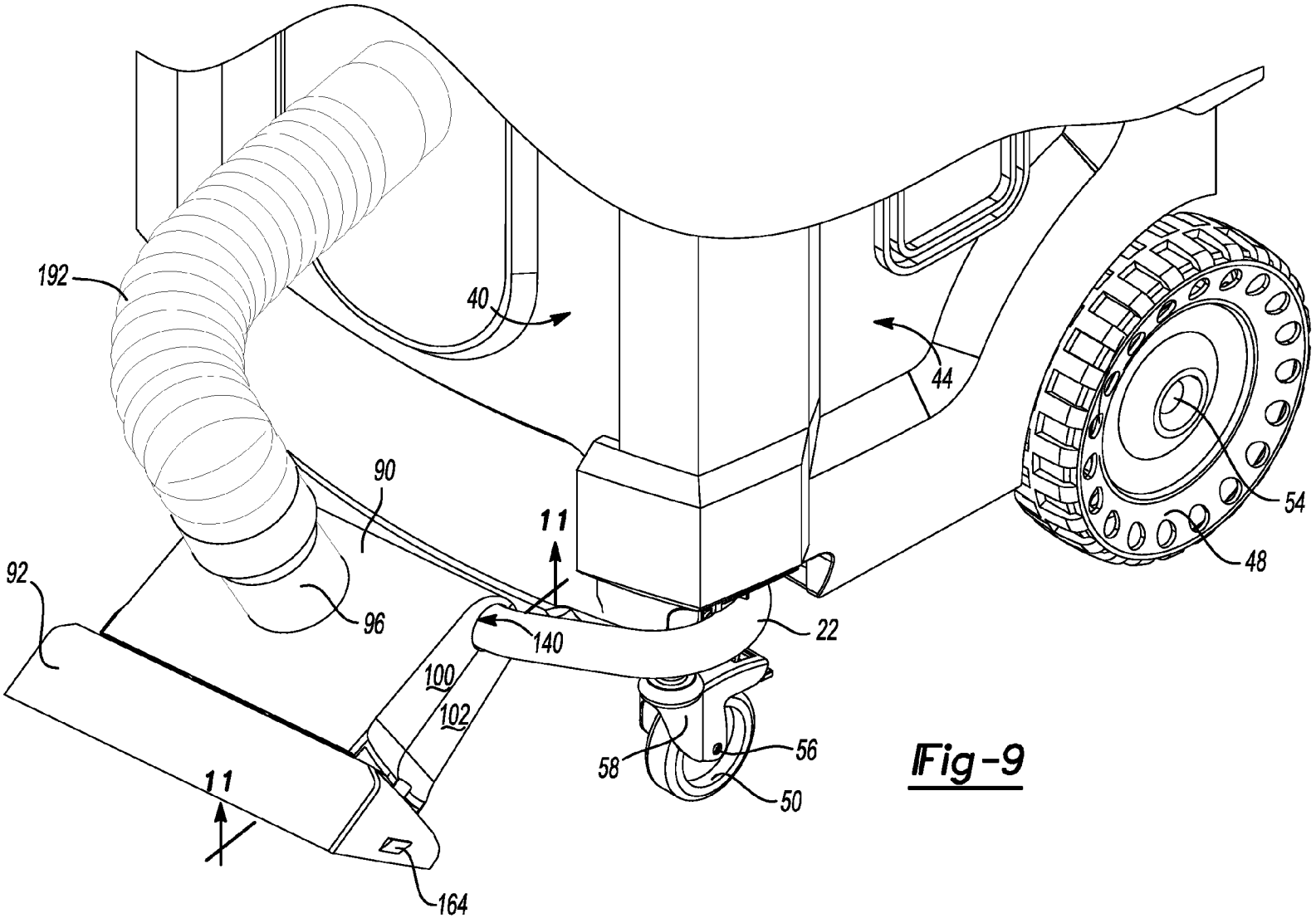
FIG. 9 is a front perspective view of a portion of the vacuum of FIG. 1 including a floor scoop and connecting duct shown in a second (or floor nozzle) mode of operation.
Figure 10:
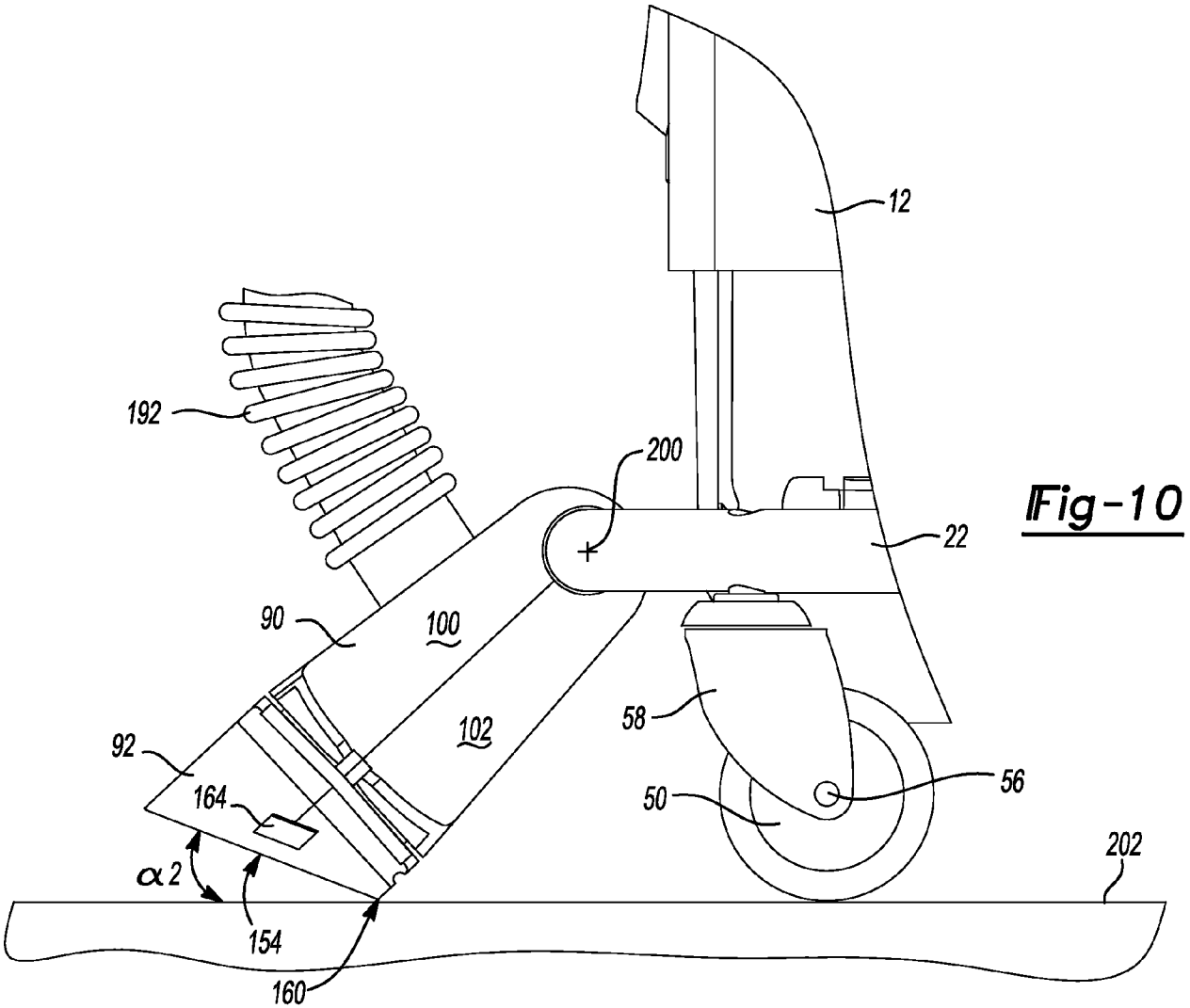
FIG. 10 is a side view of a portion of the vacuum shown in FIG. 9.
Figure 11:
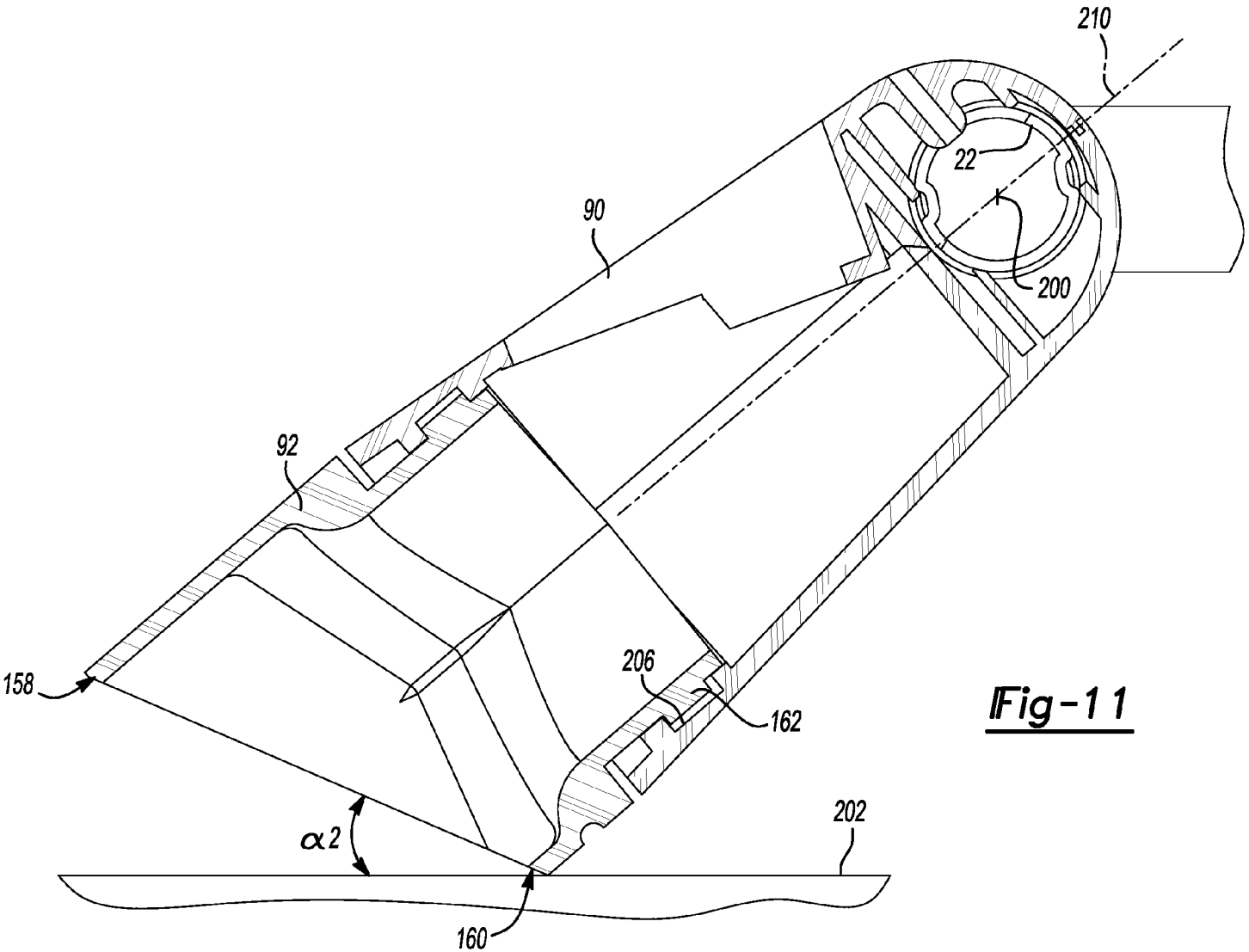
FIG. 11 is a sectional view of the floor scoop and connecting duct in the second mode taken along line 11-11 of FIG. 9.
Figure 12:
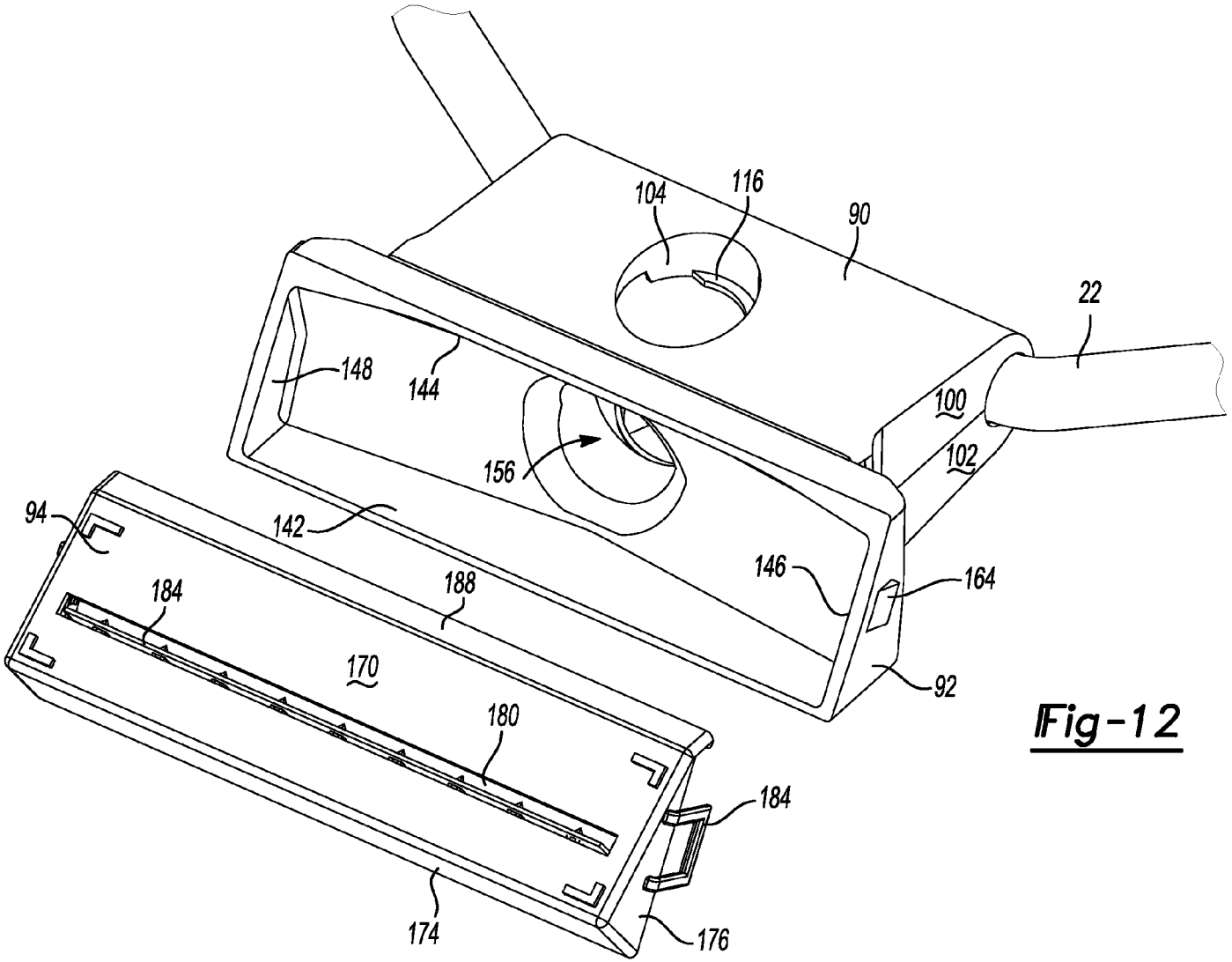
FIG. 12 is a front perspective view of the floor connecting assembly of the vacuum in FIG. 1 and illustrating a squeegee attachment offset from the floor scoop.

With particular reference now to FIGS. 9-11, operation of the vacuum in the "floor nozzle mode" will be described in greater detail. In the "floor nozzle mode," the connecting duct 90 is rotated about the mounting bar 22 (i.e., about the axis 200, FIG. 10) such that the second sweep edge 160 slides against or substantially adjacent a vacuumed surface 202. As can be appreciated from the preceding discussion, the floor scoop 92 can rotate 180 degrees about the axis 210 (FIG. 6) from the "sweep mode" position to the "floor nozzle mode," and vice-versa. The connecting hose 192 can be coupled between the intake port 36 (FIG. 1) and the hose cuff 96. In this position, the opening 154 of the floor scoop 92 can define an angle $\alpha 2$ (FIG. 10) relative to the vacuumed surface 202. The angle $\alpha 2$ can be an acute angle. In one example, the angle $\alpha 2$ can be approximately between 25 and 65 degrees. It is appreciated that this angle can be altered by rotating the connecting duct 90 about the mounting bar axis 200. In the "floor nozzle mode," the floor scoop 92, the connecting duct 90 and the connecting hose 192 each act as sequential debris-passing ducts to direct the vacuumed material into the housing 12.

Figure 13:
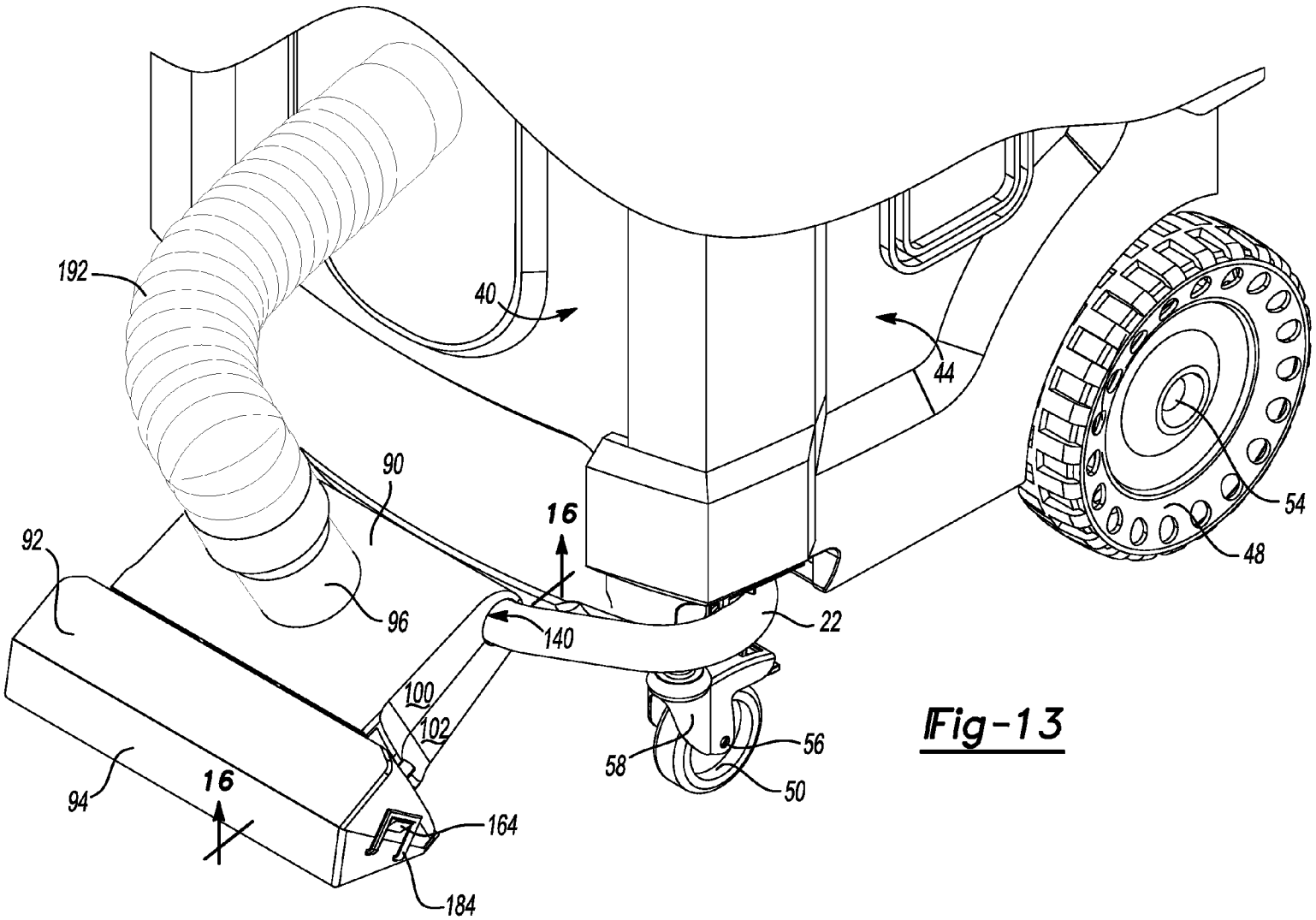
FIG. 13 is a front perspective view of a portion of the vacuum of FIG. 1 shown with the squeegee attachment connected to the floor scoop in a third (or squeegee) mode of operation.
Figure 14:
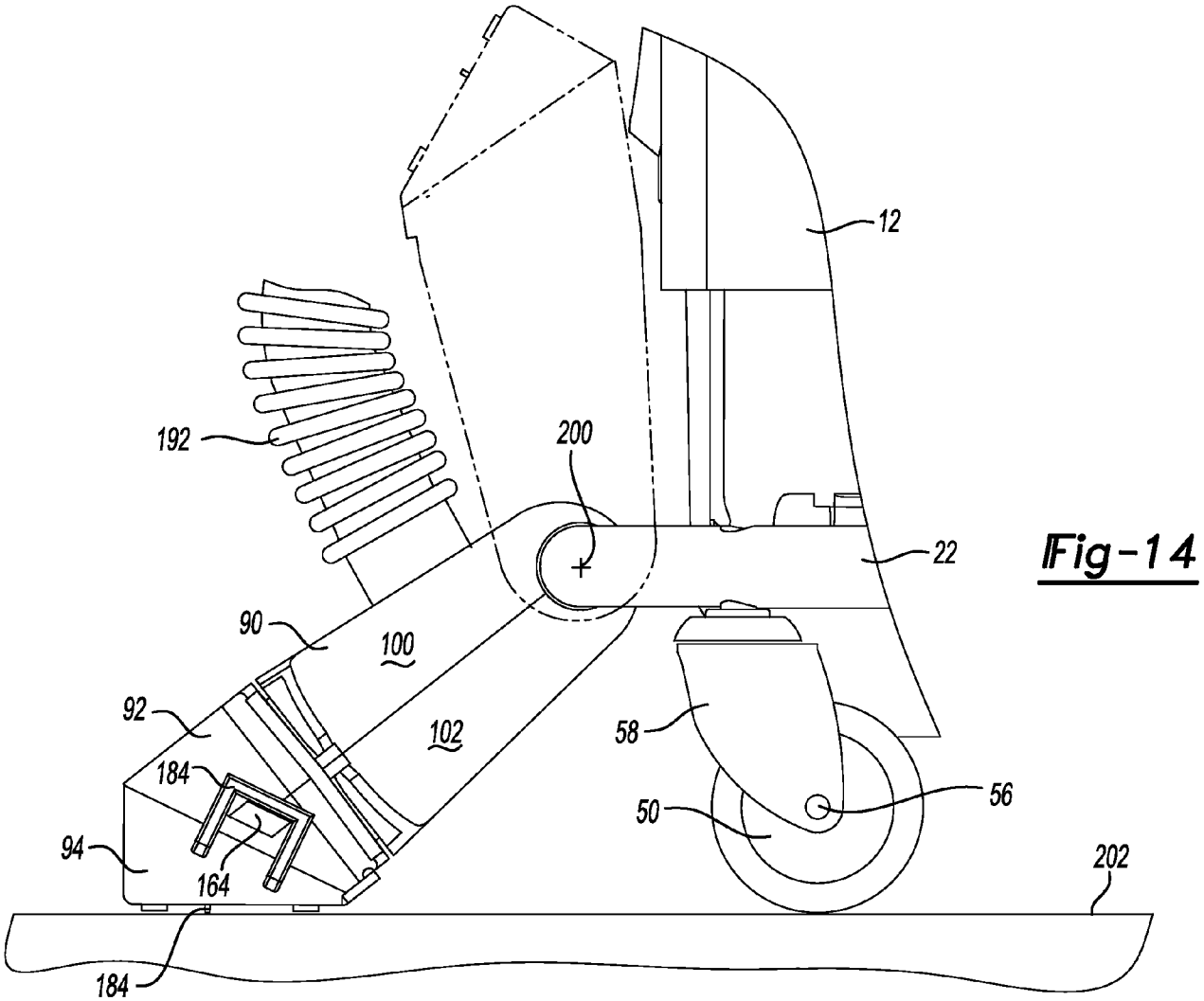
FIG. 14 is a side view of a portion of the vacuum shown in FIG. 13 (solid line) and also shown with the floor collector assembly rotated about an axis of the mounting bar in a storage position (phantom line)
Figure 15:
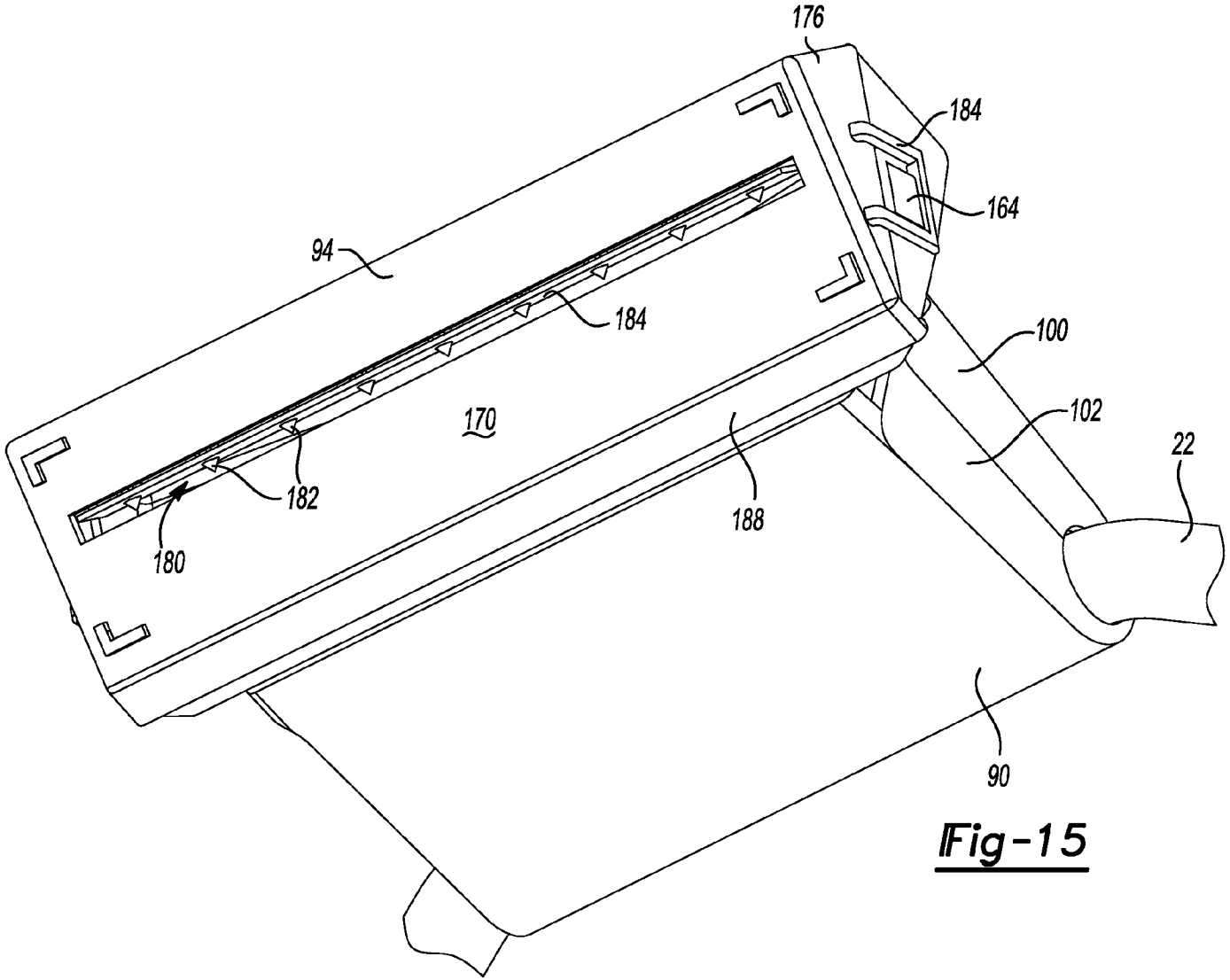
FIG. 15 is a bottom perspective view of the floor collector assembly with the squeegee attachment coupled to the floor scoop in the third mode.
Figure 16:
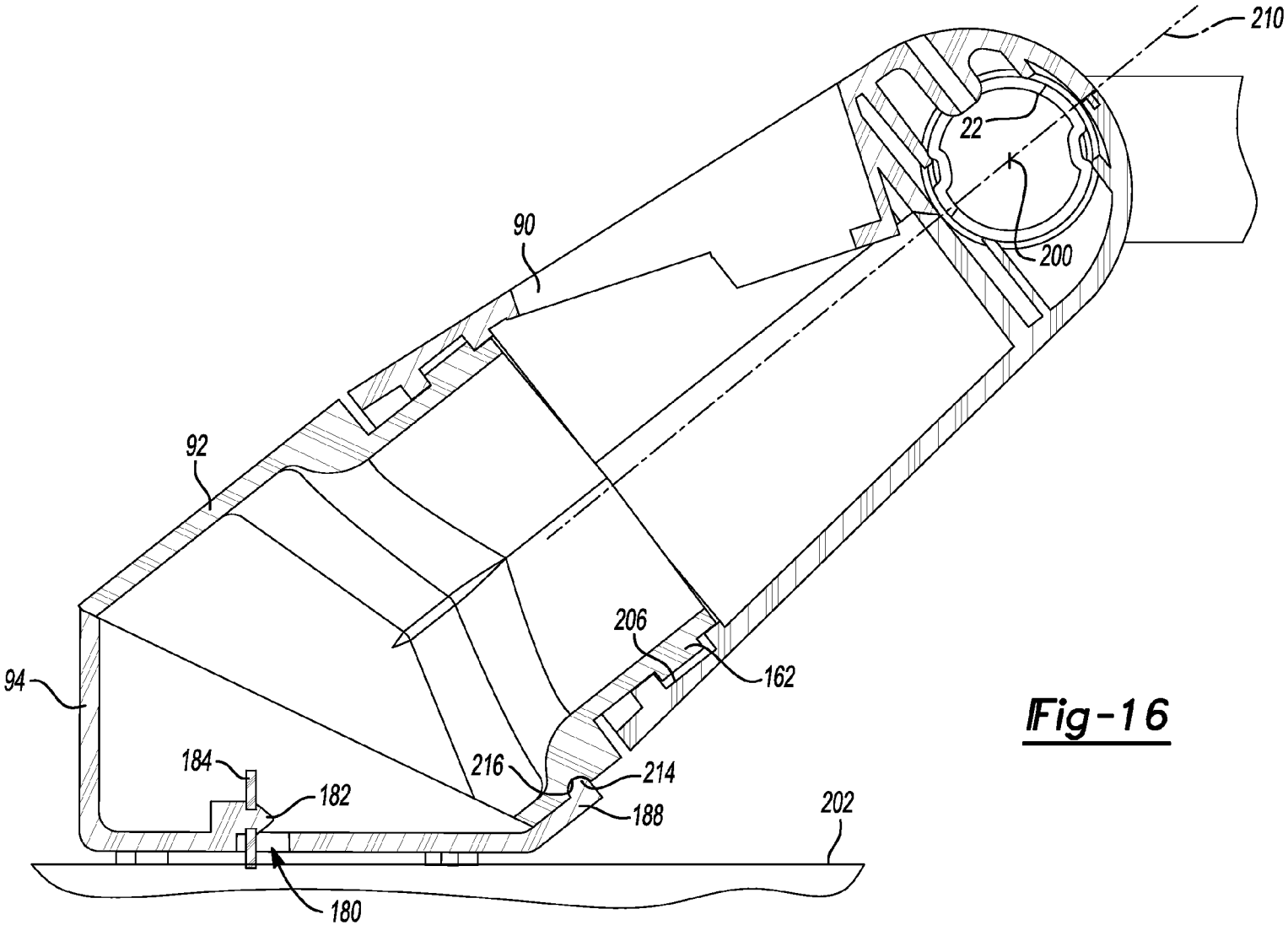
FIG. 16 is a sectional view of the floor collector assembly in the third mode taken along line 16-16 of FIG. 13.

With particular reference now to FIGS. 12-16, operation of the vacuum 10 in the "squeegee mode" will be described in greater detail. In the squeegee mode, the squeegee adapter 94 is coupled to the floor scoop 92. More specifically, the flap 188 of the squeegee adapter 94 can be located against the first wall 144 of the floor scoop 92. As best illustrated in FIG. 16, a locating ridge 214 defined on the flap 188 can nest within a groove 216 defined on the wall 144 of the floor scoop 92. The ears 184 of the squeegee attachment 94 can ramp over the respective tabs 164 of the floor scoop 92 until they reach a position beyond the ramps 164 (FIG. 13). In the squeegee mode, the bottom surface 170 can be substantially parallel to the vacuumed surface 202 (FIG. 14). Again, It is appreciated that this angle can be altered by rotating the connecting duct 90 about the mounting bar axis 200. The blade 184 can extend through the longitudinal passage 180 for slidably traversing along the vacuumed surface 202. As can be appreciated, the blade 184 can assist in directing liquid (and/or solid debris) to a position near the longitudinal passage 180 to be siphoned. In the "squeegee mode," the squeegee adapter 94, the floor scoop 92, the connecting duct 90 and the connecting hose 192 each act as sequential debris-passing ducts to direct the vacuumed material into the housing 12.

Figure 17:
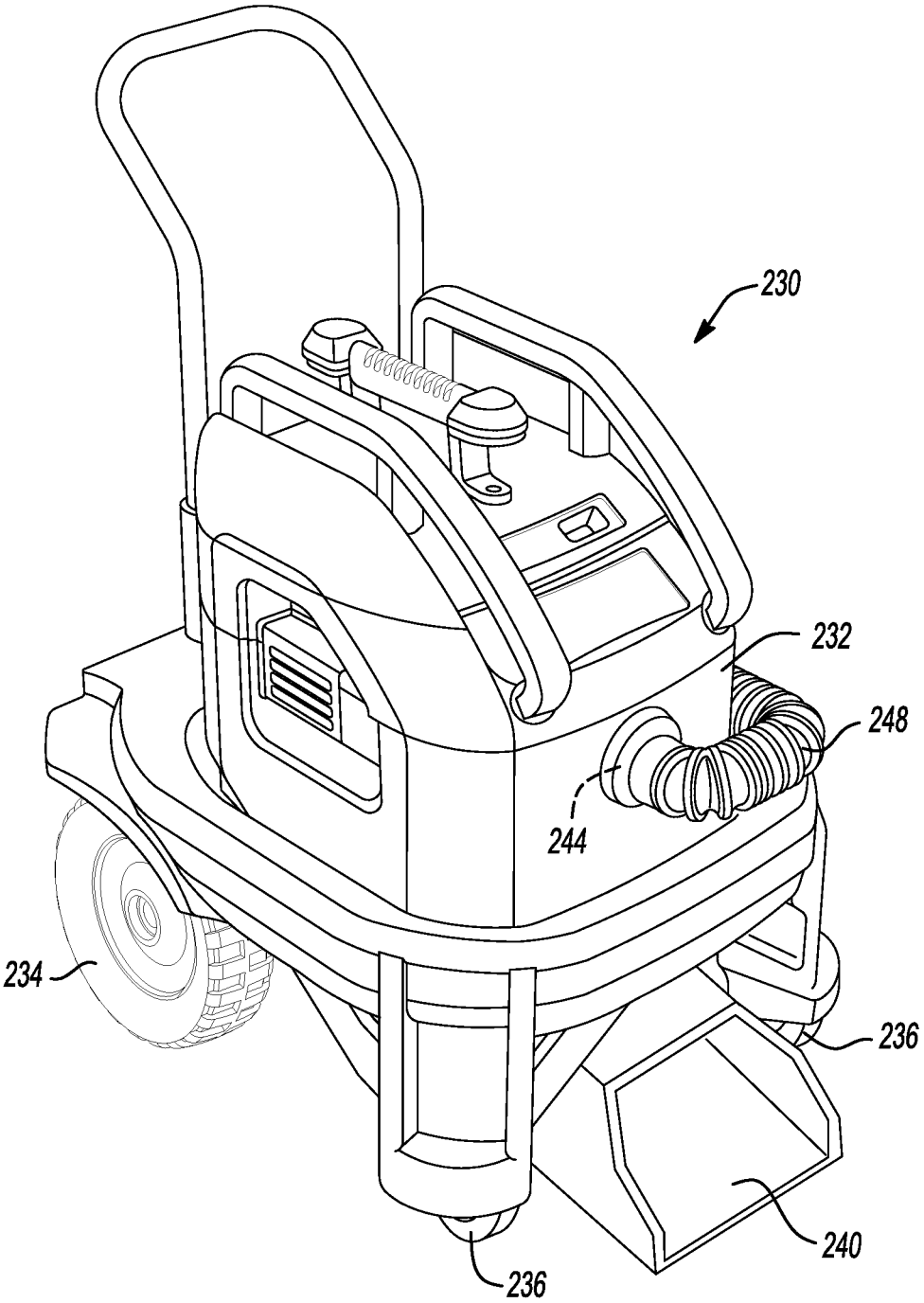

With reference now to FIG. 17, a wet/dry vacuum according to additional features is shown and generally identified at reference numeral 230. The vacuum 230 can define a cube-like body 232. A first and second pair of wheels, 234 and 236, respectively, may be coupled to the vacuum 230 for rolling the vacuum 230 across a floor. The first pair of wheels 234 (only one shown) may be fixed for rotation about an axis. The second pair of wheels 236 can be caster wheels that rotate about axles within carriers, similar to described with wheels 50 (FIG. 1).

The wet/dry vacuum 230 can define a floor scoop 240. The floor scoop 240 can be removable from the body 232. Furthermore, the height of the floor scoop 240 may be changed as needed. An intake port 244 can be integrally formed or otherwise coupled to the body 232. In one mode of operation, the wet/dry vacuum 230 can vacuum directly through a hose 248, via the intake port 244, and/or the wet/dry vacuum 230 may vacuum directly through the floor scoop 240. In one example, the wet/dry vacuum 230 can vacuum through the floor scoop 240 via the intake port 244 (such as described above) or alternatively, the floor scoop 240 can vacuum directly into the body 232 by way of a secondary intake port 250 as will be described in relation to FIG. 18.

Figure 18:
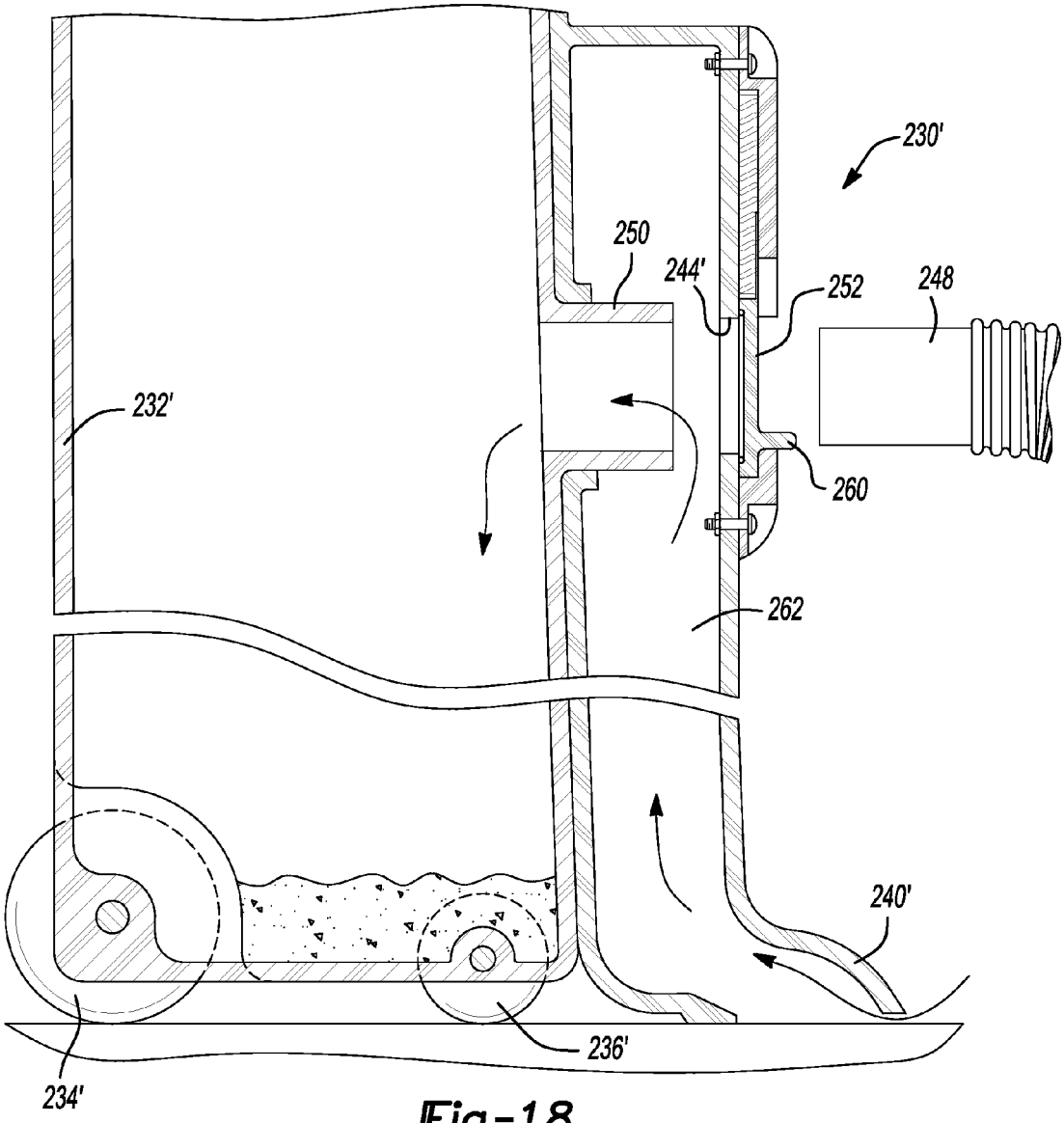
FIG. 18 is a cross-sectional view of an exemplary wet/dry vacuum constructed in accordance to additional features of the present disclosure.

As shown in FIG. 18, a wet/dry vacuum 230' can define an access door 252 that may open and/or close automatically. The access door 252 can be biased into a closed position by a biasing member 254. The access door 252 may be opened manually, or automatically, for example when contacted by a hose 248 or by lifting an access finger 260. When the access door is open, the hose 248 can couple to the secondary port 250. When the hose 248 is removed, the vacuum action is directed to the floor scoop 240' through an access duct 262. Other configurations for the access door are contemplated such as a pivoting or rotation access door for example.

Figure 20:
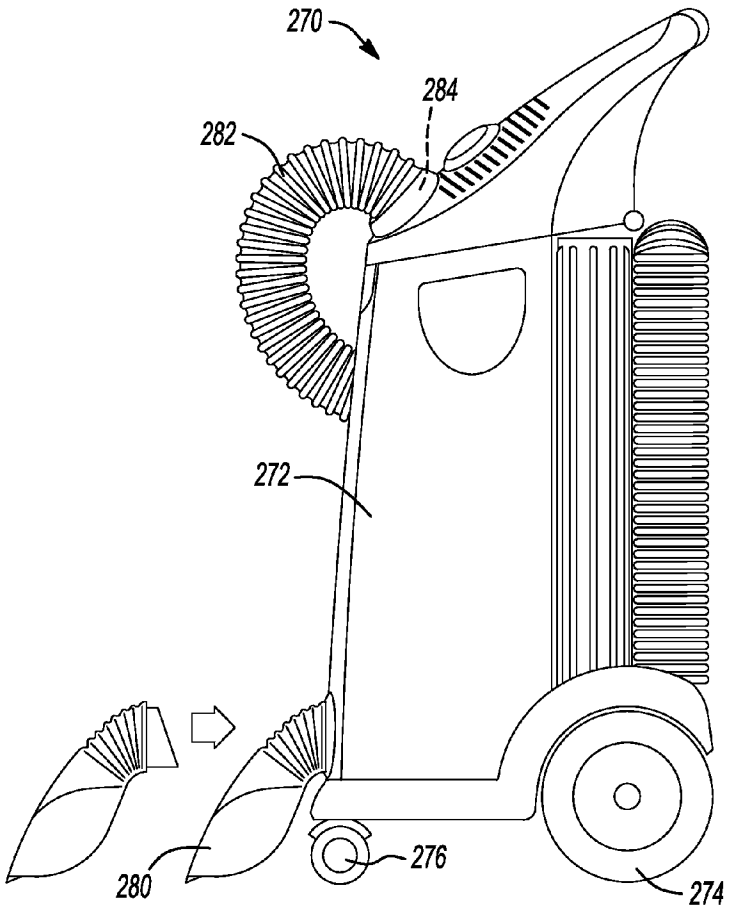
FIG. 20 is a side view of the exemplary wet/dry vacuum of FIG. 19.
Figure 19:
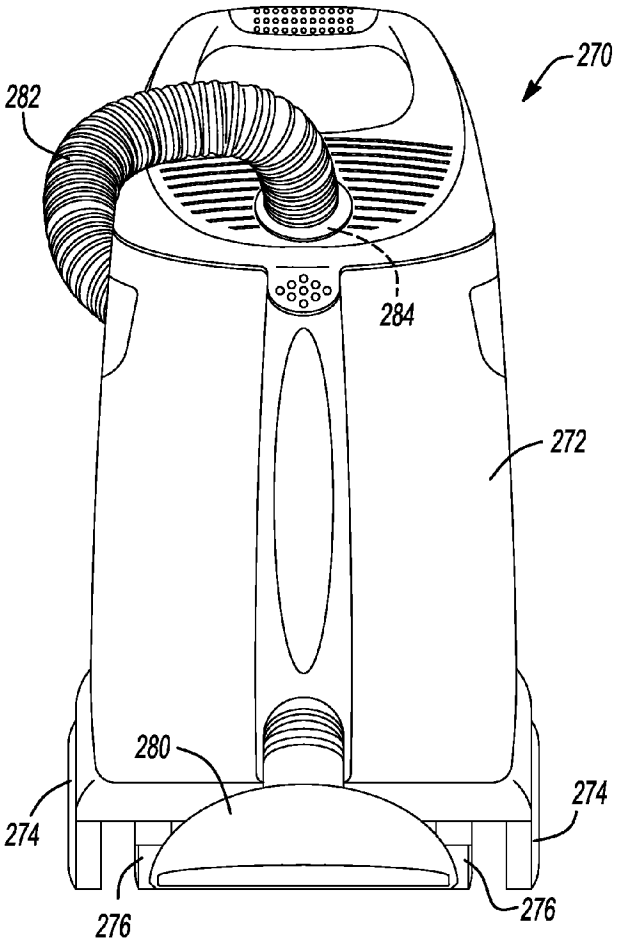
FIG. 19 is a front view of an exemplary wet/dry vacuum constructed in accordance to additional features of the present disclosure.
Figure 21:
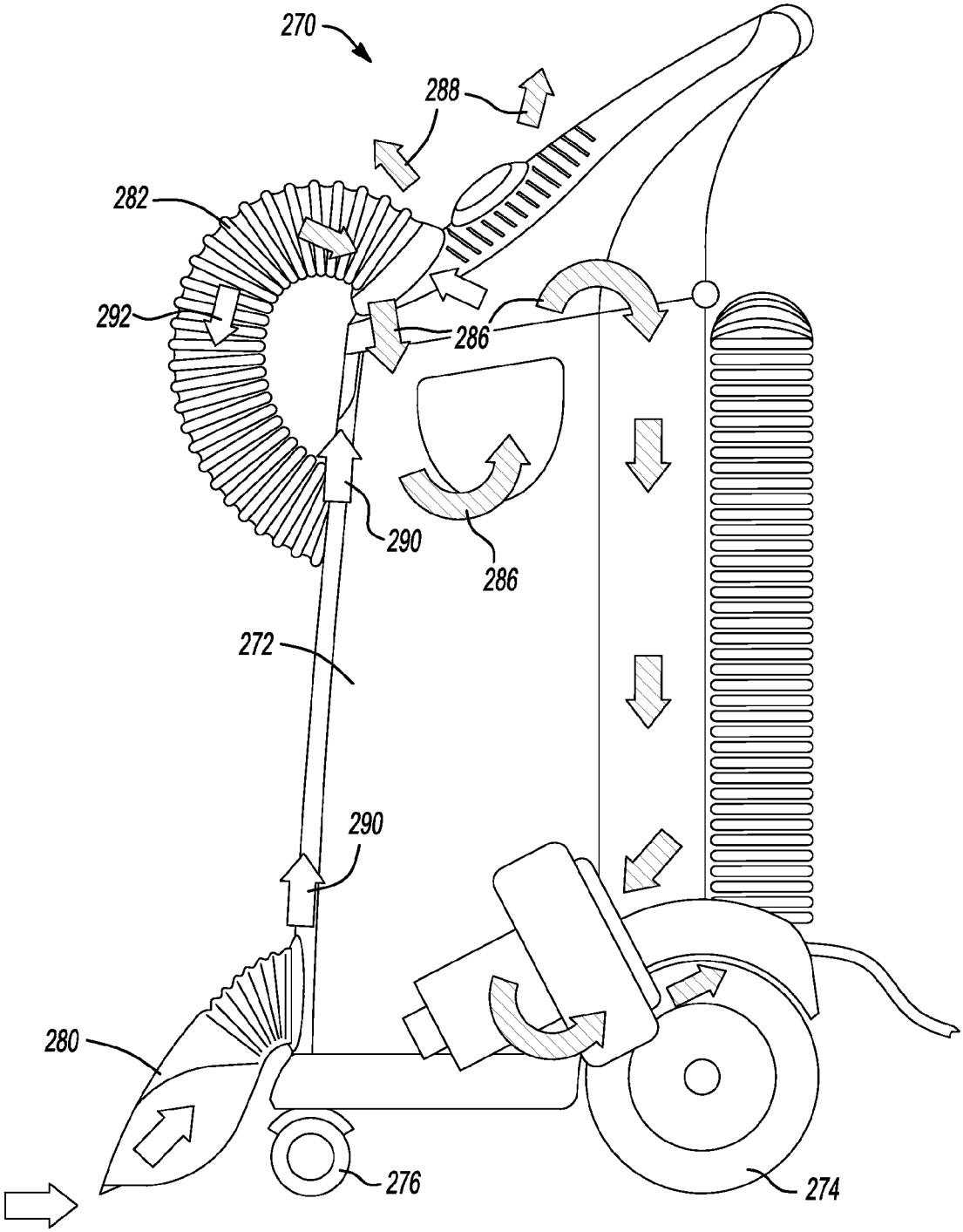
FIG. 21 illustrates exemplary flow paths through the wet/dry vacuum of FIG. 20.

Turning now to FIGS. 19-21, a wet/dry vacuum according to additional features is shown and generally identified at reference numeral 270. The wet/dry vacuum 270 can define a rectangular body 272. A first and second pair of wheels, 274 and 276, respectively, may be coupled to the vacuum 270 for rolling the vacuum 270 across a floor. The first pair of wheels 274 may be fixed for rotation about an axis. The second pair of wheels 276 can be caster wheels that rotate about axles within carriers, similar to described with wheels 50 (FIG. 1).

The wet/dry vacuum 270 can define a floor scoop 280. The floor scoop 280 can be removable from the body 272. A hose 282 can be selectively coupled to an intake port 284. FIG. 21 illustrates exemplary flow paths of the wet/dry vacuum 270. The flow paths may include, for example, a main hose path 286, a main exhaust path 288, a secondary floor scoop vacuum path 290 and/or a secondary hose blower exhaust path 292.

With reference to FIGS. 22-25, an exemplary vacuum constructed in accordance with the present teachings is shown and generally identified at 10'. The vacuum 10' can generally include all of the features described and illustrated with respect to the vacuum 10' as shown in FIG. 1. In the vacuum 10', an alternative floor collector assembly 300 is provided that can be rotatably coupled to a mounting bar 22 in the same manner as the floor collector assembly 20 as shown in FIG. 1.

Figure 23:
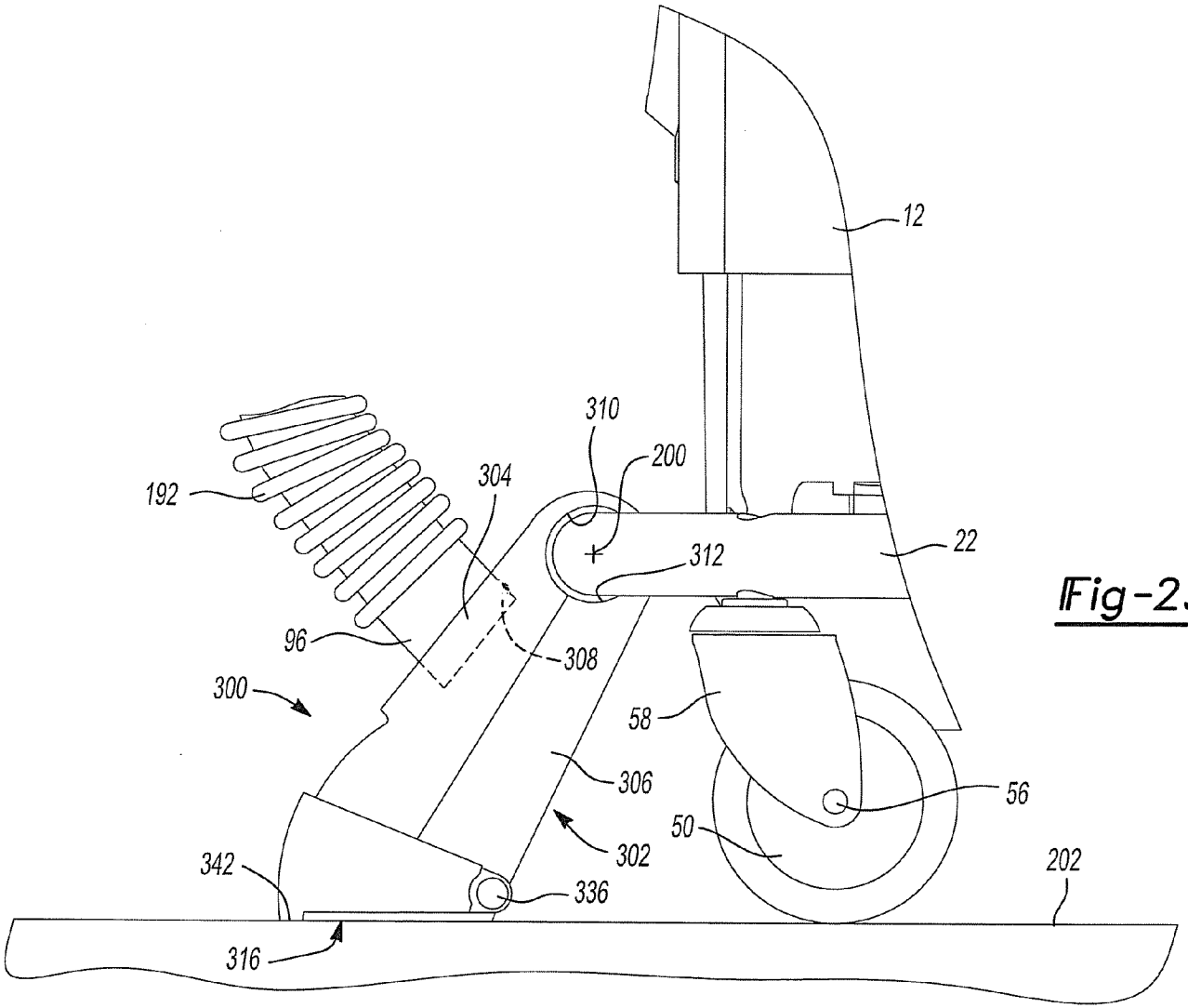
FIG. 23 is a side view of a dust pan of the vacuum shown in FIG. 22 with the visor portion shown in a down position.

With reference to FIG. 23, the floor collection assembly 300 can include a floor scoop portion 302 defined by a first clamshell portion 304 and a second clamshell portion 306. The first clamshell portion can define a mounting sleeve 308 which can be adapted to receive a hose cuff 96 of a vacuum hose 192. The mounting sleeve 308 is designed to receive the hose cuff 96 when the floor collection assembly 300 is in a use position. A first half-cylinder 310 can be defined on the first clamshell portion 304 and a second-half cylinder portion 312 can be defined on the second clamshell portion 306. The first and second half cylinder portions 310, 312 are designed to pivotally engage the mounting bar 22 when the first and second clamshell halves 304, 306 are engaged to one another.

Figure 22:
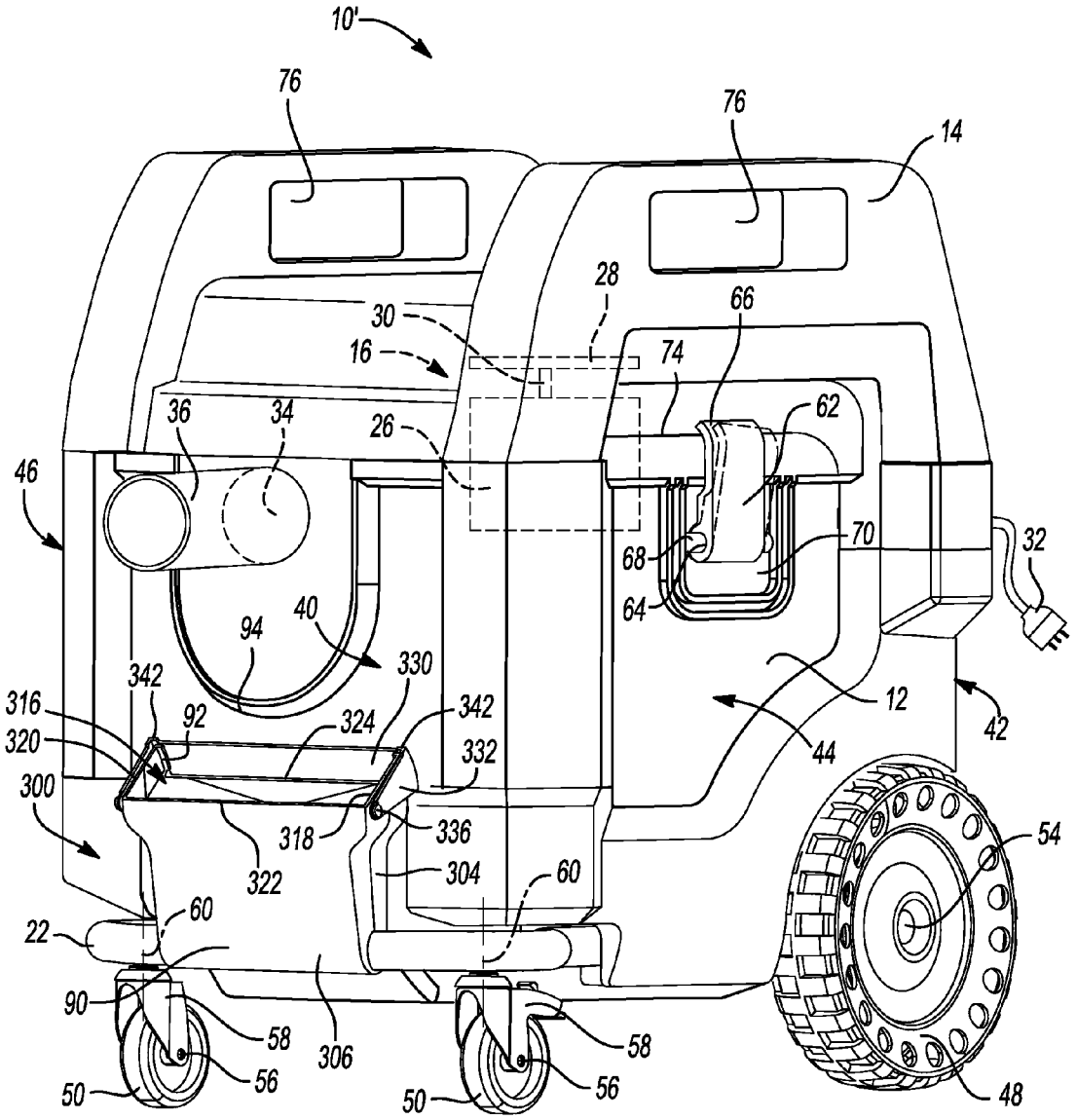
FIG. 22 is a front perspective view of a further exemplary wet/dry vacuum constructed in accordance with the teachings of the present disclosure.
Figure 24:
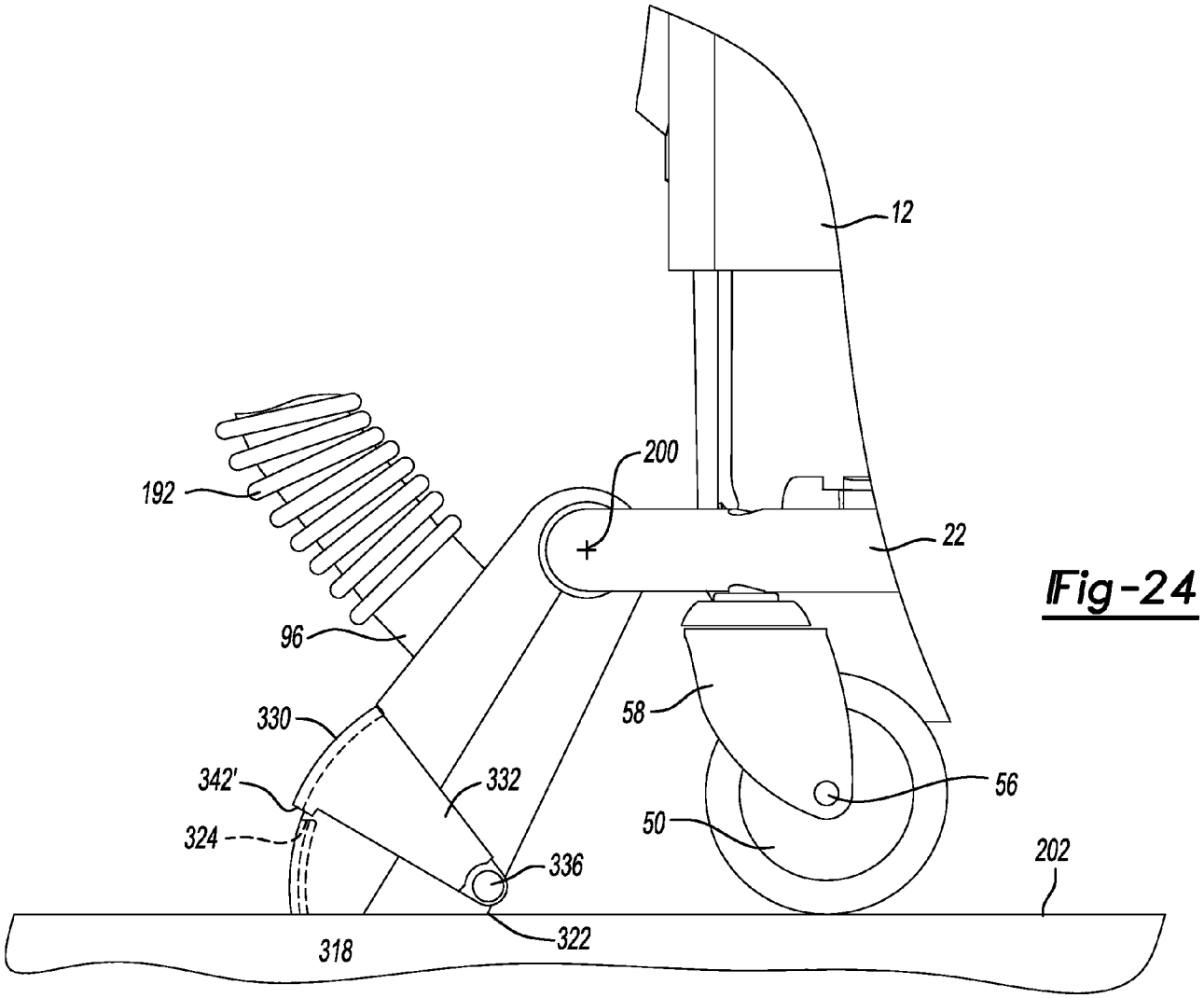
FIG. 24 is a side view similar to FIG. 23 with the visor portion shown in an up position.

The floor scoop 302 includes an open end portion 316 that is designed to be disposed adjacent the floor when the floor collection assembly 300 is a use position as illustrated in FIGS. 23 and 24. FIG. 22 shows the floor collection assembly 300 in an upright, idle, position when the floor collection assembly 300 is not in use. As illustrated in FIG. 22, the floor scoop 302 discloses a pair of side walls 318, 320 on opposite sides of the opening 316 while the second clamshell portion 306 includes a rear wall portion 322 extending between the side walls 318, 320 at a level generally equal to the side walls 318, 320 while the first clamshell portion 304 includes a front wall portion 324 which is recessed above the floor level in the use position as illustrated in FIG. 24. The recessed wall portion 324 allows the floor collection assembly 300 to be used in picking up larger debris which can fit underneath the recessed edge of the front wall portion 324.

Figure 27:
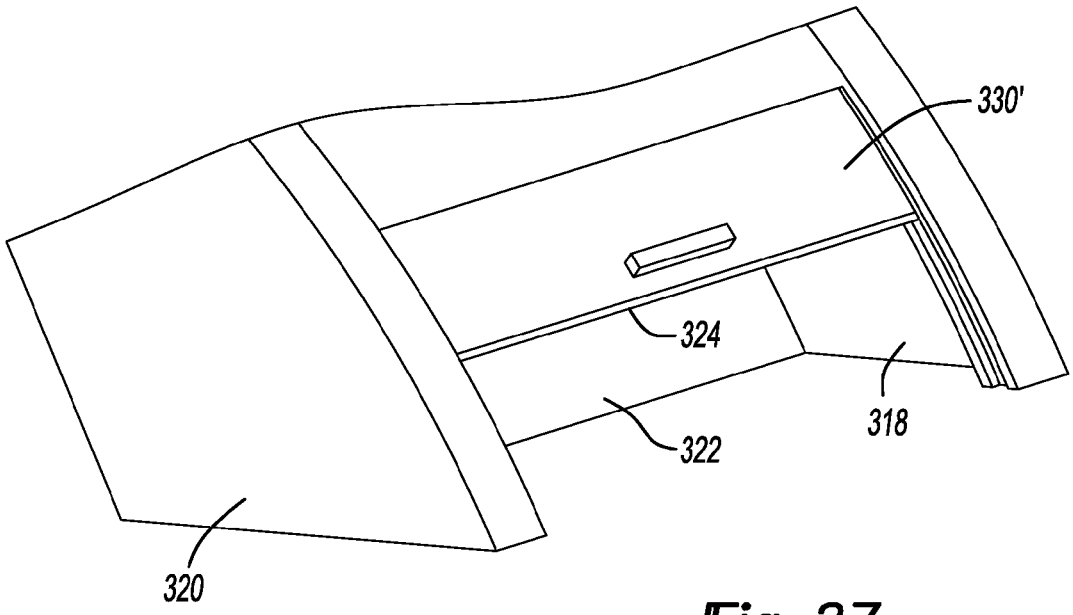
FIG. 27 is a perspective view illustrating a movable panel slidably mounted to the floor scoop.

A movable panel/visor 330 can be pivotally mounted to the floor scoop 302 so as to move from a retracted position as illustrated in FIG. 24 to a use position as illustrated in FIG. 23 wherein the movable panel/visor 330 covers at least a portion of the recess in the front wall 324 as illustrated in FIG. 23 so as to provide improved fluid suction capability in a fluid vacuum mode. As mentioned above, the movable panel/visor 330 can be pivotally mounted or slidably mounted (see FIG. 27) to the floor scoop 302 and in the pivoting embodiment shown in FIGS. 22-25, includes pivot arms 332, disposed on opposite sides that are pivotally mounted to the floor scoop 302 at pivot points 336. The floor scoop 302 can be formed from a rigid plastic, and the movable panel/visor 330 can be formed from the same material or can be formed from a relatively more flexible material than the scoop 302.

Figure 26:
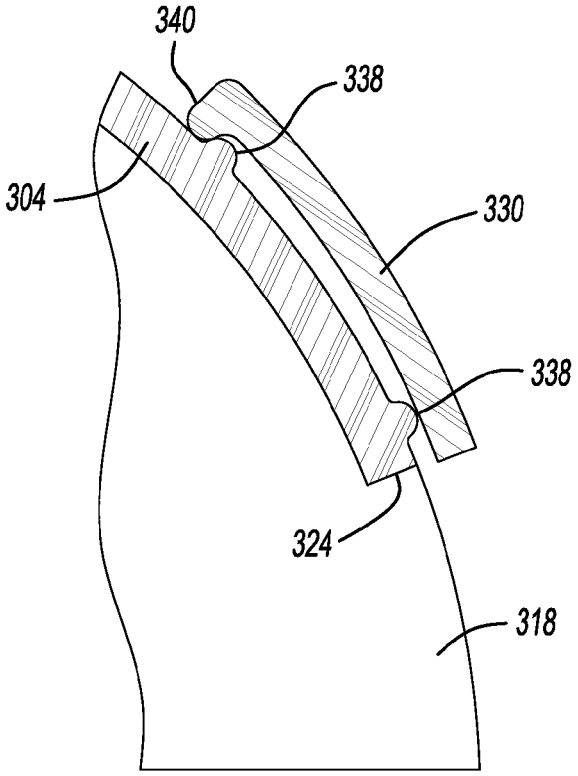
FIG. 26 is a cross-sectional view illustrating exemplary detents for holding the movable panel in an open or closed position.

The movable panel/visor 330 can be provided with retaining features, as illustrated in FIG. 26 such as a projecting rib 338, that can be engaged with corresponding projections 340 provided on the floor scoop 302 in order to secure the movable panel/visor 330 in its up or down position.

It should be understood that although the movable panel/visor 330 is shown as pivoting between the open and closed positions, the floor collection assembly 300 can also, alternatively, include a sliding movable panel/visor 330 (FIG. 27) for closing off the recessed edge 324 of the front wall in order improve the water suction capability of the floor collection assembly 300. As illustrated in FIG. 23, the movable panel/visor 330 can further include projection portions 342 disposed along a bottom edge thereof that provide a spacer function to allow water to pass under the movable panel/visor 330 to be sucked through the floor collection assembly 300. The projection portions 342 can be disposed at opposite ends of the movable panel/visor 330 or can be intermittently spaced there along.

Figure 25:
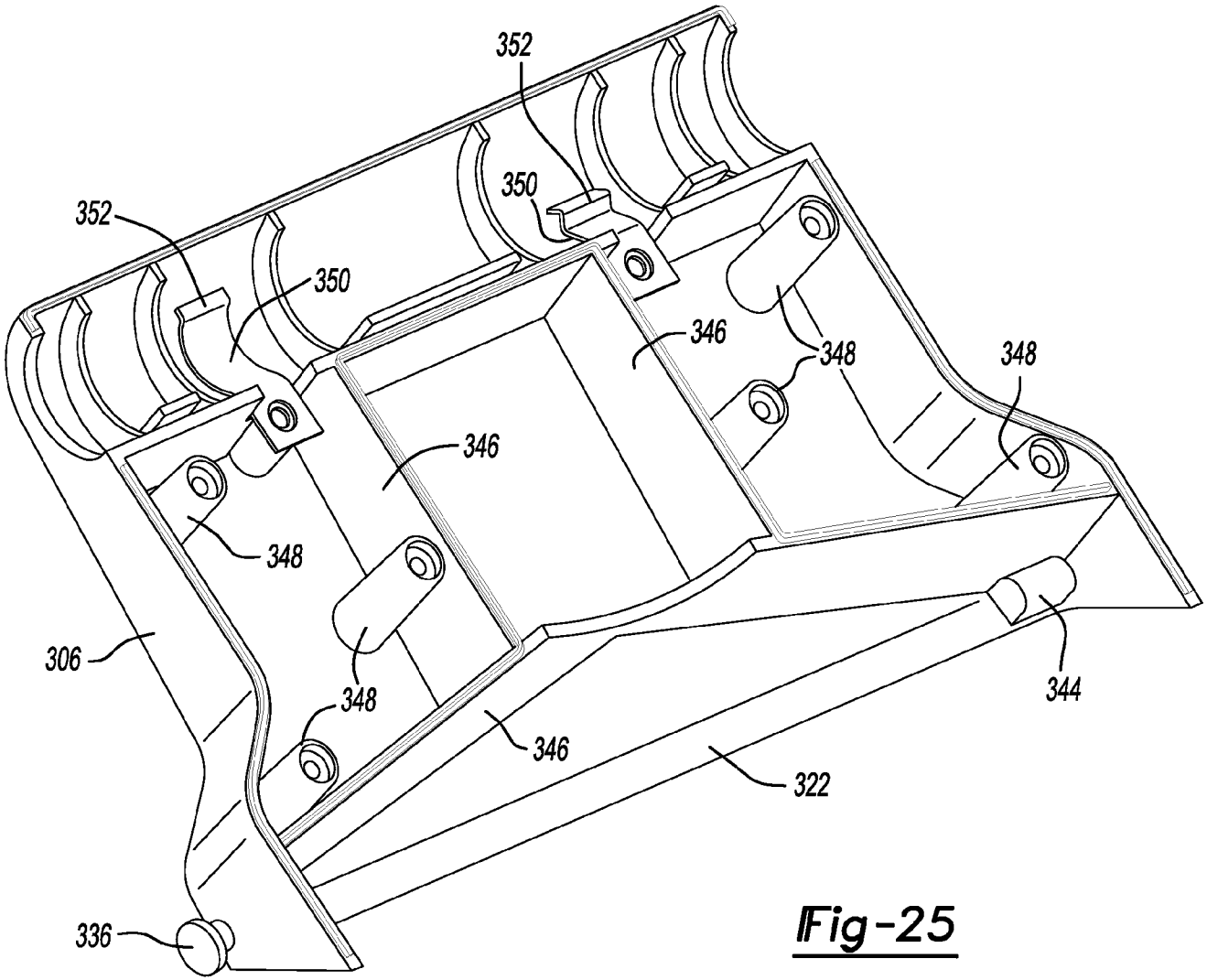
FIG. 25 is a perspective view of an interior of one of the clamshell members of the dust pan shown in FIG. 22.

With reference to FIG. 25, the pivots 336 for supporting the movable panel/visor 330 can be received in boss portions 344 provided on the second clamshell portion 306. Furthermore, the first and second clamshell portions 304, 306 can each be provided with interior walls 346 (only clamshell 306 is shown) which mate with one another in order to funnel debris and fluids internally toward the mounting sleeve 308 of the clamshell 304 to be collected through the hose connected to the hose cuff 96. Furthermore, the clamshell portions 304, 306 can be provided with mounting bosses 348 which can receive threaded fasteners for mounting the first and second clamshell portions 304, 306, respectively, together in an assembled condition.

In addition, position springs 350 can be provided in one or both of the first and second half cylinder portions 310, 312, as illustrated in FIG. 25, for engaging a corresponding recess or recesses provided in the surface of the mounting bar 22 in order to provide a positive locking engagement of the floor collection assembly 300 in the upright idle position, or in the active floor engaging position. The position springs 350 can take the form of leaf springs having a bent engagement portion 352 that can be designed to be engaged within a recess in the mounting bar 22. The position springs 350 can be fastened to the interior of the clamshell portions by threaded fasteners, rivets or other fastening techniques. In addition, it should be understood that other types of position springs can also be utilized such as those that are integrally formed with the clamshell portion as illustrated in FIG. 11, or alternative spring biased locking members can be used. With the design of the present disclosure, the floor scoop 302 can be easily converted between a debris pickup and a water pickup use mode by simply pivoting or otherwise moving the movable panel/visor 330 in order to open or close the recessed portion 324 in the front wall of the floor scoop 302.

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise above. For example, a "blower mode" may be incorporated on any wet/dry vacuum described above such that air may be exhausted through the hose (as depicted at reference 292 in FIG. 21) Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A vacuum comprising:

a housing having a handle facilitating mobility of the housing by a user's hand during operation of the vacuum and an inlet adapted to receive debris being vacuumed;

a mounting member fixedly coupled to the housing;

a floor collector assembly rotatably disposed about the mounting member for movement between a stored position and a use position wherein the floor collector assembly is adjacent a floor, the floor collector assembly including a connecting duct and a floor scoop that defines an opening having a pair of side walls and a rear wall extending to a position adjacent to the floor in said use position, said floor collector assembly including a recessed front wall that is spaced from the floor in the use position by a distance greater than said side walls and said rear wall and further comprising a movable panel operable in a first position to cover said recess in said front wall and in a second position to uncover said recess in said front wall, wherein said floor collector assembly includes a spring device engaging said mounting member and releasably securing said floor collector assembly in said use position and said stored position.

2. The vacuum of claim 1, wherein said movable panel is pivotally mounted to said floor scoop.

3. The vacuum of claim 1, wherein said movable panel includes a bottom edge having at least one projection extending therefrom.

4. The vacuum of claim 3, wherein said at least one projection includes a pair of projections disposed at opposite ends of said movable panel.

5. The vacuum of claim 1, wherein said floor scoop includes a sleeve portion adapted to connect with an end of a vacuum hose.

6. The vacuum of claim 1, wherein said spring device includes at least one leaf spring mounted to said floor collector.

7. The vacuum of claim 1, further comprising means for securing said movable panel in said second position.

8. The vacuum of claim 1, wherein said movable panel is slidably mounted to said floor scoop.

9. The vacuum of claim 1, further comprising means for releasably securing said movable panel in said first position.

10. The vacuum of claim 1, wherein said floor scoop is made from a rigid plastic and said movable panel is made from a relatively more flexible material than said floor scoop.

11. A vacuum comprising:

a housing having a handle facilitating mobility of the housing by a user's hand during operation of the vacuum and an inlet adapted to receive debris being vacuumed;

a floor collector assembly in communication with said inlet including a floor scoop that defines an opening having a rear wall extending to a position adjacent to a floor and including a recessed front wall that is spaced from the floor by a distance greater than said rear wall and further comprising a movable panel operable in a first position to selectively cover said recess in said front wall and in a second position to uncover said recess in said front wall, wherein said movable panel includes a bottom edge having at least one projection extending therefrom and contacting the floor in said first position to space said bottom edge apart from the floor.

12. The vacuum of claim 11, wherein said movable panel is pivotally mounted to said floor collector assembly.

13. The vacuum of claim 11, wherein said floor collector includes a sleeve portion adapted to connect with an end of a vacuum hose.

14. The vacuum of claim 11, wherein said at least one projection includes a pair of projections disposed at opposite ends of said movable panel.

15. The vacuum of claim 11, further comprising means for securing said movable panel in said second position.

16. The vacuum of claim 11, further comprising means for releasably securing said movable panel in said first position.

17. The vacuum of claim 11, wherein said movable panel is slidably mounted to said floor scoop.

18. The vacuum of claim 11, wherein said floor scoop is made from a rigid plastic and said movable panel is made from a relatively more flexible material than said floor scoop.

19. A vacuum comprising:

a housing having a handle facilitating mobility of the housing by a user's hand during operation of the vacuum, said housing defining a tank receiving matter being vacuumed;

a conduit extending from said housing and in communication with said tank;

a motor assembly enclosed within said housing and generating suction through said conduit;

a mounting member fixedly coupled to the housing;

a floor scoop connected to said mounting member and in communication with said conduit, said floor scoop defining an opening having a rear wall extending to a position adjacent to a floor and including a recessed front wall that is spaced from the floor by a distance greater than said rear wall; and a movable panel operable in a first position to selectively cover said recess in said front wall and in a second position to uncover said recess in said front wall, said movable panel including a first engagement member selectively engaging a second engagement member disposed on said floor scoop to selectively retain said movable panel in said second position, wherein said floor scoop is rotatable relative to the mounting member between a stored position and a use position wherein said floor scoop is adjacent a floor for vacuuming said matter.

20. The vacuum of claim 19, wherein said conduit is selectively detachable from said floor scoop for manipulation by the user's hand to collect matter independently from said floor scoop.

* * * * *